US009898947B2

(12) United States Patent
Yoshizawa

(10) Patent No.: US 9,898,947 B2
(45) Date of Patent: Feb. 20, 2018

(54) IMAGE DISPLAY DEVICE AND CONTROL METHOD OF IMAGE DISPLAY DEVICE

(71) Applicant: SEIKO EPSON CORPORATION, Tokyo (JP)

(72) Inventor: Koichi Yoshizawa, Shimosuwa-Machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/575,400

(22) Filed: Dec. 18, 2014

(65) Prior Publication Data

US 2015/0187246 A1 Jul. 2, 2015

(30) Foreign Application Priority Data

Dec. 26, 2013 (JP) ..... 2013-268718

(51) Int. Cl.
*G09G 3/18* (2006.01)

(52) U.S. Cl.
CPC ..... *G09G 3/18* (2013.01); *G09G 2320/041* (2013.01); *G09G 2320/0646* (2013.01); *G09G 2320/0693* (2013.01); *G09G 2360/145* (2013.01); *G09G 2360/16* (2013.01)

(58) Field of Classification Search
None
See application file for complete search history.

(56) References Cited

U.S. PATENT DOCUMENTS 7,355,648 B1 * 4/2008 Braun ..... B60Q 9/008 348/370
2006/0007409 A1 * 1/2006 Sato ..... G03B 21/13 353/97
2006/0215130 A1 * 9/2006 Nakamura ..... G03B 9/02 353/97
2008/0100645 A1 * 5/2008 Nitta ..... G09G 3/3426 345/690

FOREIGN PATENT DOCUMENTS

JP A-2004-523001 7/2004
WO WO 02/069030 A2 9/2002

* cited by examiner

*Primary Examiner* — Duane N Taylor, Jr.
(74) *Attorney, Agent, or Firm* — Oliff PLC

(57) ABSTRACT

An image display device includes: a first light modulation device including a plurality of display pixels; a lighting unit including a plurality of light adjusting elements; an illumination distribution storage unit that stores an illumination range information which represents an illumination range; a light adjusting information determination unit that determines light adjusting information for controlling the light adjusting elements of the lighting unit based on a feature quantity of the first image information corresponding to the display pixels in the illumination range; an illumination distribution detection unit that detects an illumination distribution information which represents an illumination distribution; and an illumination distribution updating unit that updates the illumination range information based on the illumination distribution information.

11 Claims, 18 Drawing Sheets

41

SA S

| | | | | | | | | | | | |
|---|---|---|---|---|---|---|---|---|---|---|---|
| 0 | 0 | 0 | 0 | 0 | 0 | 0 | 0 | 0 | 0 | 0 | 0 |
| 0 | 0 | 0 | 0 | 0 | 0.01 | 0.01 | 0 | 0 | 0 | 0 | 0 |
| 0 | 0 | 0.01 | 0.02 | 0.05 | 0.07 | 0.07 | 0.05 | 0.02 | 0.01 | 0 | 0 |
| 0 | 0 | 0.02 | 0.10 | 0.21 | 0.29 | 0.29 | 0.21 | 0.10 | 0.02 | 0 | 0 |
| 0 | 0 | 0.05 | 0.21 | 0.47 | 0.63 | 0.63 | 0.47 | 0.21 | 0.05 | 0 | 0 |
| 0 | 0.01 | 0.07 | 0.29 | 0.63 | 0.85 | 0.85 | 0.63 | 0.29 | 0.07 | 0.01 | 0 |
| 0 | 0.01 | 0.07 | 0.29 | 0.63 | 0.85 | 0.85 | 0.63 | 0.29 | 0.07 | 0.01 | 0 |
| 0 | 0 | 0.05 | 0.21 | 0.47 | 0.63 | 0.63 | 0.47 | 0.21 | 0.05 | 0 | 0 |
| 0 | 0 | 0.02 | 0.10 | 0.21 | 0.29 | 0.29 | 0.21 | 0.10 | 0.02 | 0 | 0 |
| 0 | 0 | 0.01 | 0.02 | 0.05 | 0.07 | 0.07 | 0.05 | 0.02 | 0.01 | 0 | 0 |
| 0 | 0 | 0 | 0 | 0 | 0.01 | 0.01 | 0 | 0 | 0 | 0 | 0 |
| 0 | 0 | 0 | 0 | 0 | 0 | 0 | 0 | 0 | 0 | 0 | 0 |

FIG. 5

T1

| | | | | | | | | | | | |
|---|---|---|---|---|---|---|---|---|---|---|---|
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 1 | 1 | 1 | 1 | 0 | 0 | 0 | 0 |
| 0 | 0 | 0 | 0 | 1 | 1 | 1 | 1 | 0 | 0 | 0 | 0 |
| 0 | 0 | 0 | 0 | 1 | 1 | 1 | 1 | 0 | 0 | 0 | 0 |
| 0 | 0 | 0 | 0 | 1 | 1 | 1 | 1 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG. 12

T2

| | | | | | | | | | | | |
|---|---|---|---|---|---|---|---|---|---|---|---|
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0.03 | 0.15 | 0.18 | 0.18 | 0.15 | 0.03 | 0 | 0 | 0 |
| 0 | 0 | 0 | 0.15 | 0.67 | 0.82 | 0.82 | 0.67 | 0.15 | 0 | 0 | 0 |
| 0 | 0 | 0 | 0.18 | 0.82 | 1 | 1 | 0.82 | 0.18 | 0 | 0 | 0 |
| 0 | 0 | 0 | 0.18 | 0.82 | 1 | 1 | 0.82 | 0.18 | 0 | 0 | 0 |
| 0 | 0 | 0 | 0.15 | 0.67 | 0.82 | 0.82 | 0.67 | 0.15 | 0 | 0 | 0 |
| 0 | 0 | 0 | 0.03 | 0.15 | 0.18 | 0.18 | 0.15 | 0.03 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG. 13

T3

| | | | | | | | | | | | |
|---|---|---|---|---|---|---|---|---|---|---|---|
| 0 | 0 | 0 | 0 | 0 | 0 | 0 | 0 | 0 | 0 | 0 | 0 |
| 0 | 0 | 0 | 0 | 0 | 0.01 | 0.01 | 0 | 0 | 0 | 0 | 0 |
| 0 | 0 | 0.01 | 0.02 | 0.05 | 0.07 | 0.07 | 0.05 | 0.02 | 0.01 | 0 | 0 |
| 0 | 0 | 0.02 | 0.10 | 0.21 | 0.29 | 0.29 | 0.21 | 0.10 | 0.02 | 0 | 0 |
| 0 | 0 | 0.05 | 0.21 | 0.47 | 0.63 | 0.63 | 0.47 | 0.21 | 0.05 | 0 | 0 |
| 0 | 0.01 | 0.07 | 0.29 | 0.63 | 0.85 | 0.85 | 0.63 | 0.29 | 0.07 | 0.01 | 0 |
| 0 | 0.01 | 0.07 | 0.29 | 0.63 | 0.85 | 0.85 | 0.63 | 0.29 | 0.07 | 0.01 | 0 |
| 0 | 0 | 0.05 | 0.21 | 0.47 | 0.63 | 0.63 | 0.47 | 0.21 | 0.05 | 0 | 0 |
| 0 | 0 | 0.02 | 0.10 | 0.21 | 0.29 | 0.29 | 0.21 | 0.10 | 0.02 | 0 | 0 |
| 0 | 0 | 0.01 | 0.02 | 0.05 | 0.07 | 0.07 | 0.05 | 0.02 | 0.01 | 0 | 0 |
| 0 | 0 | 0 | 0 | 0 | 0.01 | 0.01 | 0 | 0 | 0 | 0 | 0 |
| 0 | 0 | 0 | 0 | 0 | 0 | 0 | 0 | 0 | 0 | 0 | 0 |

FIG. 14

FIG. 15A

DC1

| | | | | | | |
|---|---|---|---|---|---|---|
| 0 | 0 | 0.18 | 0.64 | 0.18 | 0 | 0 |

FIG. 15B

DC2

| |
|---|
| 0 |
| 0 |
| 0.18 |
| 0.64 |
| 0.18 |
| 0 |
| 0 |

FIG. 15C

DC3

| | | | | | | |
|---|---|---|---|---|---|---|
| 0.01 | 0.06 | 0.22 | 0.42 | 0.22 | 0.06 | 0.01 |

FIG. 15D

DC4

| |
|---|
| 0.01 |
| 0.06 |
| 0.22 |
| 0.42 |
| 0.22 |
| 0.06 |
| 0.01 |

IMAGE DISPLAY DEVICE AND CONTROL METHOD OF IMAGE DISPLAY DEVICE

The entire disclosure of Japanese Patent Application No. 2013-268718, filed Dec. 26, 2013, is expressly incorporated by reference herein.

BACKGROUND

1. Technical Field

The present invention relates to an image display device and a control method of an image display device.

2. Related Art

In the related art, a display device is known that includes a light source, a display screen including first and second spatial light modulators provided so as to modulate light from the light source, and an optical system configured so as to project light modulated by the first spatial light modulator onto the first surface of the display screen (for example, JP-T-2004-523001). In such a display device, it is possible to display a high-contrast image over a wide dynamic range.

However, in the display device disclosed in JP-T-2004-523001, even if the first and second light modulators are made to correspond to each other during light adjustment, the influence of illumination on pixels around the associated pixels occurs. That is, since pixels around the second spatial light modulator are also illuminated due to the spread of illumination light emitted from the first spatial light modulator, a desired image may not be able to be output. For example, the brightness of image light emitted from the second spatial light modulator may be reduced. Therefore, control considering the spread of illumination light from the first spatial light modulator is required. In addition, when using the two spatial light modulators in this manner, the arrangement of the two spatial light modulators or optical elements disposed between the two spatial light modulators may change due to an assembling error, a temporal change, or the like. When such a change occurs, the illumination distribution of light, which has passed through the first spatial light modulator, in the second spatial light modulator changes. For this reason, there has been a problem in that accurate gradation reproduction cannot be realized when the illumination distribution changes from the value expected at the beginning. Hereinafter, the "spatial light modulator" is referred to as a "light modulation device".

SUMMARY

An advantage of some aspects of the invention is to solve at least apart of the problems described above, and the invention can be implemented as the following forms or application examples.

Application Example 1

This application example is directed to an image display device including: a first light modulation device that includes a plurality of display pixels and modulates light based on first image information; a lighting unit that includes a plurality of light adjusting elements and emits adjusted light to the first light modulation device; an illumination distribution storage unit that stores an illumination range information, the illumination range information represents an illumination range when light emitted from the light adjusting elements illuminates the display pixels of the first light modulation device; a light adjusting information determination unit that determines light adjusting information for controlling the light adjusting elements of the lighting unit based on a feature quantity of the first image information corresponding to the display pixels in the illumination range; an illumination distribution detection unit that detects an illumination distribution information, the illumination distribution information represents an illumination distribution when light emitted from the light adjusting pixels of the lighting unit illuminates the display pixels of the first light modulation device; and an illumination distribution updating unit that updates the illumination range information based on the illumination distribution information.

According to the image display device described above, the image display device described above includes the first light modulation device including display pixels and the lighting unit including light adjusting elements. The light adjusting information determination unit determines the light adjusting information for controlling the light adjusting elements of the lighting unit based on the feature quantity of the first image information corresponding to the display pixels in the illumination range of the first light modulation device illuminated by the light adjusted by the light adjusting elements. The illumination distribution detection unit detects the illumination distribution when the light emitted from the light adjusting pixels of the lighting unit illuminates the display pixels of the first light modulation device. The illumination distribution updating unit updates the information of the illumination range stored in the illumination distribution storage unit based on the information of the detected illumination distribution. Therefore, even when the illumination distribution of the first light modulation device changes, the information of the illumination range stored in the illumination distribution storage unit is updated. As a result, the lighting unit can perform light adjustment in consideration of the feature quantity of the first pixel information corresponding to the updated illumination range.

Application Example 2

This application example is directed to the image display device according to the application example described above, wherein the illumination distribution storage unit further stores distribution information of an illumination intensity when light emitted from the light adjusting elements illuminates the display pixels of the first light modulation device, the illumination distribution updating unit updates the distribution information of the illumination intensity stored in the illumination distribution storage unit based on the information of the illumination distribution detected by the illumination distribution detection unit, and the image display device further includes an illumination value calculation unit, which calculates an illumination value of light reaching each of the display pixels of the first light modulation device based on the light adjusting information of the lighting unit and the distribution information of the illumination intensity, and an image information generation unit, which generates second image information to be set in the first light modulation device based on the first image information and the illumination value calculated by the illumination value calculation unit.

According to the image display device described above, the illumination distribution updating unit updates the distribution information of the illumination intensity stored in the illumination distribution storage unit based on the information of the illumination distribution detected by the illumination distribution detection unit. The illumination value calculation unit calculates the illumination value of light reaching each of the display pixels of the first light modulation device based on the light adjusting information and the updated distribution information of the illumination intensity. The image information generation unit generates the second image information to be set in the first light modulation device based on the illumination value and the first image information. Therefore, it is possible to generate the second image information to be set in the first light modulation device in consideration of the distribution of the illumination intensity of the illumination light from the lighting unit that has been updated. That is, it is possible to generate the pixel information (pixel value) to be set in the display pixels.

Application Example 3

This application example is directed to the image display device according to the application example described above, wherein in the image information generation unit, a value obtained by dividing a pixel value of the first image information by the illumination value is set as a pixel value of the second image information.

According to the image display device described above, the value obtained by dividing the first image information by the illumination value is set as the second image information. Therefore, also in the second image information, it is possible to maintain the brightness of the first image information almost equally while taking into consideration the brightness control by the lighting unit.

Application Example 4

This application example is directed to the image display device according to the application example described above, wherein in the light adjusting information determination unit, the feature quantity of the first image information is set to a maximum value of a pixel value of the first image information in the illumination range.

According to the image display device described above, the feature quantity of the first image information is set to the maximum value of the pixel value of the first image information in the updated illumination range. Therefore, since it is possible to suppress a reduction in the brightness of the illumination value with which the display pixel of the first light modulation device is illuminated, it is possible to perform light adjustment that can almost reproduce the brightness of the input first image information.

Application Example 5

This application example is directed to the image display device according to the application example described above, wherein the illumination distribution detection unit is configured to include an image sensor unit, which captures a light image, and an information detection unit, which detects the information of the illumination distribution based on captured image data obtained by imaging performed by the image sensor unit.

According to the image display device described above, the illumination distribution detection unit is configured to include the image sensor unit and the information detection unit. Therefore, it is possible to detect the information of the illumination distribution based on the captured image data obtained by the imaging performed by the image sensor unit.

Application Example 6

This application example is directed to the image display device according to the application example described above, wherein the image sensor unit generates the captured image data by capturing a light image when light emitted from the light adjusting pixels of the lighting unit reaches the first light modulation device.

According to the image display device described above, the image sensor unit generates the captured image data by capturing a light image when the light emitted from the light adjusting pixels of the lighting unit reaches the first light modulation device. Therefore, it is possible to detect the information of the illumination distribution.

Application Example 7

This application example is directed to the image display device according to the application example described above, wherein the image sensor unit generates the captured image data by imaging a range including an image displayed by the image display device.

According to the image display device described above, the image sensor unit generates the captured image data by imaging a range including an image displayed by the image display device. Therefore, it is possible to detect the information of the illumination distribution based on the display image.

Application Example 8

This application example is directed to the image display device according to the application example described above, wherein the illumination distribution detection unit is configured to include a second feature quantity detection unit, which detects a second feature quantity that affects the illumination distribution, and an information detection unit, which detects the information of the illumination distribution based on the second feature quantity detected by the second feature quantity detection unit.

According to the image display device described above, the illumination distribution detection unit is configured to include the second feature quantity detection unit that detects the second feature quantity affecting the illumination distribution and the information detection unit that detects the information of the illumination distribution based on the second feature quantity. Therefore, it is possible to detect the information of the illumination distribution based on the second feature quantity.

Application Example 9

This application example is directed to the image display device according to the application example described above, wherein the second feature quantity detection unit detects a distance between the lighting unit and the first light modulation device as the second feature quantity.

According to the image display device described above, the second feature quantity detection unit detects the distance between the lighting unit and the first light modulation device as the second feature quantity. Therefore, it is possible to detect the information of the illumination distribution based on the distance between the lighting unit and the first light modulation device.

Application Example 10

This application example is directed to the image display device according to the application example described above, wherein, the second feature quantity detection unit may detect an ambient temperature of the lighting unit and the first light modulation device as the second feature quantity.

According to the image display device described above, the second feature quantity detection unit detects the ambient temperature of the lighting unit and the first light modulation device as the second feature quantity. Therefore, it is possible to detect the information of the illumination distribution based on the ambient temperature of the lighting unit and the first light modulation device.

Application Example 11

This application example is directed to a control method of an image display device including a first light modulation device that includes a plurality of display pixels and modulates light based on first image information, a lighting unit that includes a plurality of light adjusting elements and emits adjusted light to the first light modulation device, and an illumination distribution storage unit that stores an illumination range information, the illumination range information represents an illumination range when light emitted from the light adjusting elements illuminates the display pixels of the first light modulation device. The control method includes: determining light adjusting information for controlling the light adjusting elements of the lighting unit based on a feature quantity of the first image information corresponding to the display pixels in the illumination range; detecting an illumination distribution information, the illumination distribution information represents an illumination distribution when light emitted from the light adjusting pixels of the lighting unit illuminates the display pixels of the first light modulation device; and updating the illumination range information based on the illumination distribution information.

According to the control method of an image display device described above, even when the illumination distribution of the first light modulation device changes, the information of the illumination range stored in the illumination distribution storage unit is updated. As a result, the lighting unit can perform light adjustment in consideration of the feature quantity of the first pixel information corresponding to the updated illumination range.

Application Example 12

This application example is directed to the control method of an image display device according to the application example described above, wherein the illumination distribution storage unit further stores distribution information of an illumination intensity when light emitted from the light adjusting elements illuminates the display pixels of the first light modulation device, in the updating of the illumination distribution, the distribution information of the illumination intensity stored in the illumination distribution storage unit is updated based on the information of the illumination distribution detected in the detection of the illumination distribution, and the method further includes calculating an illumination value of light reaching each of the display pixels of the first light modulation device based on the light adjusting information of the lighting unit and the distribution information of the illumination intensity, and generating second image information to be set in the first light modulation device based on the first image information and the illumination value calculated in the calculation of the illumination value.

According to the control method of an image display device described above, it is possible to generate the second image information to be set in the first light modulation device in consideration of the distribution of the illumination intensity of the illumination light from the lighting unit that has been updated. That is, it is possible to generate the pixel information (pixel value) to be set in the display pixels.

In addition, when the image display device and the control method of an image display device described above are implemented using a computer provided in the image display device, the above-described forms or application examples can also be configured in a form, such as a program for realizing the function or a recording medium on which the program is recorded in a computer-readable manner. Various kinds of computer-readable media, such as a flexible disk, a hard disk drive (HDD), a compact disk read only memory (CD-ROM), a digital versatile disk (DVD), a Blu-ray (registered trademark) disc, a magneto-optic disc, a nonvolatile memory card, an internal storage device (a semiconductor memory, such as a random access memory (RAM) or a read only memory (ROM)) of an image display device, and an external storage device (for example, a universal serial bus (USB) memory), can be used as recording media.

BRIEF DESCRIPTION OF THE DRAWINGS

The invention will be described with reference to the accompanying drawings, wherein like numbers reference like elements.

FIG. 5 is an explanatory view of the intensity distribution in the illumination range of the liquid crystal light valve for display.

FIG. 12 is an explanatory view showing the information of the illumination distribution.

FIG. 13 is an explanatory view showing the information of the illumination distribution.

FIG. 14 is an explanatory view showing the information of the illumination distribution.

FIGS. 15A to 15D are explanatory views showing the diffusion characteristics based on a Gaussian distribution, where FIG. 15A is an explanatory view of the diffusion characteristics in the horizontal direction at a short distance, FIG. 15B is an explanatory view of the diffusion characteristics in the vertical direction at a short distance, FIG. 15C is an explanatory view of the diffusion characteristics in the horizontal direction at a long distance, and FIG. 15D is an explanatory view of the diffusion characteristics in the vertical direction at a long distance.

DESCRIPTION OF EXEMPLARY EMBODIMENTS

First Embodiment

Hereinafter, as a first embodiment of an image display device, a projector that displays an image by modulating light emitted from a light source based on image information (image signal) and projecting the modulated light onto an external screen or the like will be described with reference to the accompanying diagrams.

Figure 1:
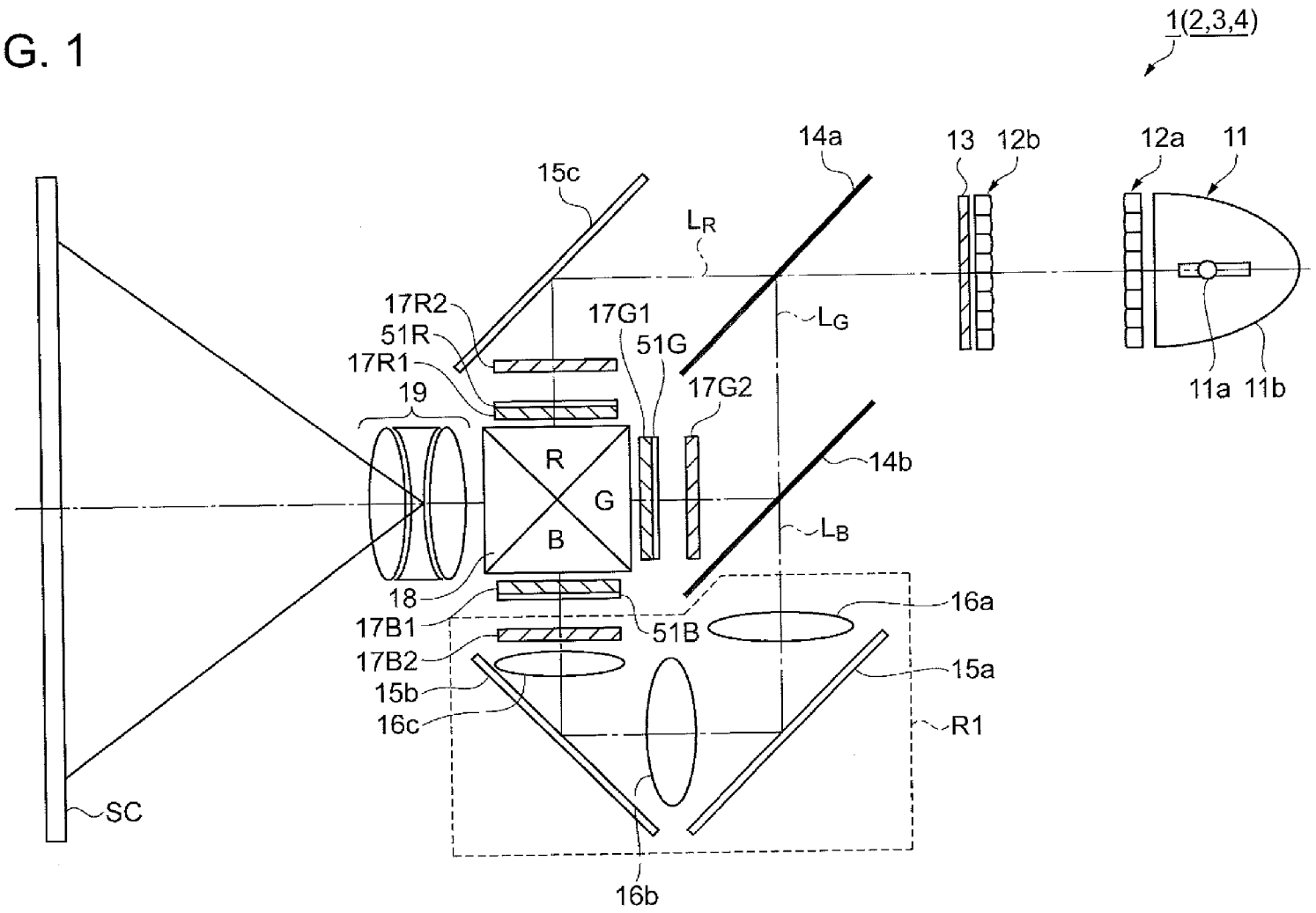
FIG. 1 is a diagram showing the schematic configuration of an optical unit of a projector according to a first embodiment.

FIG. 1 is a diagram showing the schematic configuration of an optical unit of the projector according to the first embodiment.

As shown in FIG. 1, a projector 1 includes a light source device 11, fly-eye lenses (uniform illumination unit) 12*a* and 12*b*, a polarization conversion device 13, dichroic mirrors (color separation unit) 14*a* and 14*b*, reflecting mirrors 15*a*, 15*b*, and 15*c*, liquid crystal light valves for adjusting light 17R2, 17G2, and 17B2 as a second light modulation device, liquid crystal light valves for display 17R1, 17G1, and 17B1 as a first light modulation device, image sensors 51R, 51G, and 51B, a cross dichroic prism 18, and a projection lens (projection unit) 19.

An illumination optical system in the present embodiment is configured to include the light source device 11, the fly-eye lenses 12*a* and 12*b*, and the polarization conversion device 13. The light source device 11 is configured to include a light source lamp 11*a*, such as a high-pressure mercury lamp, and a reflector 11*b* that reflects light from the light source lamp 11*a*. In addition, as a uniform illumination unit that makes the illumination distribution of light from the light source uniform in the liquid crystal light valves 17R, 17G, and 17B that are illuminated regions, the first and second fly-eye lenses 12*a* and 12*b* are provided sequentially from the light source device 11 side. Each of the fly-eye lenses 12*a* and 12*b* is configured to include a plurality of lenses, and functions as a uniform illumination unit that makes the illumination distribution of light emitted from the light source device 11 uniform in the liquid crystal light valves that are illuminated regions. Light from the light source device 11 is emitted from the uniform illumination unit to the polarization conversion device 13.

The polarization conversion device 13 is configured to include a polarizing beam splitter array (PBS array) provided on the uniform illumination unit side and a half-wavelength plate array provided on the dichroic mirror 14*a* side. The polarization conversion device 13 is provided between the uniform illumination unit and the dichroic mirror 14*a*.

Hereinafter, the configuration subsequent to the light source device 11 will be described together with the operation of each component. The dichroic mirror 14*a* that reflects blue and green light components causes red light LR, among light components emitted from the light source device 11, to be transmitted therethrough and blue light LB and green light LG to be reflected therefrom. The red light LR transmitted through the dichroic mirror 14*a* is reflected by the reflecting mirror 15*c* and is then incident on the liquid crystal light valve for adjusting red light 17R2. After the light intensity (light amount) is adjusted by the liquid crystal light valve for adjusting red light 17R2, the red light LR is incident on the liquid crystal light valve for red light display 17R1. The liquid crystal light valve for adjusting red light 17R2 is disposed between the liquid crystal light valve for red light display 17R1 and the reflecting mirror 15*c* disposed on the side of the dichroic mirror 14*a*.

On the other hand, among the color light components reflected by the dichroic mirror 14*a*, the green light LG is reflected by the dichroic mirror for green light reflection 14*b* and is then incident on the liquid crystal light valve for adjusting green light 17G2. After the light intensity (light amount) is adjusted by the liquid crystal light valve for adjusting green light 17G2, the green light LG is incident on the liquid crystal light valve for green light display 17G1. The liquid crystal light valve for adjusting green light 17G2 is disposed between the liquid crystal light valve for green light display 17G1 and the dichroic mirror 14*b* disposed on the side of the dichroic mirror 14*a*. On the other hand, the blue light LB is transmitted through the dichroic mirror 14*b* and is then incident on the liquid crystal light valve for adjusting blue light 17B2 through a relay system R1 configured to include a relay lens 16*a*, the reflecting mirror 15*a*, a relay lens 16*b*, the reflecting mirror 15*b*, and a relay lens 16*c*. After the light intensity (light amount) is adjusted by the liquid crystal light valve for adjusting blue light 17B2, the blue light LB is incident on the liquid crystal light valve for blue light display 17B1. The liquid crystal light valve for adjusting blue light 17B2 is disposed between the liquid crystal light valve for blue light display 17B1 and the relay lens 16*c* disposed on the side of the dichroic mirror 14*b*.

In the present embodiment, the liquid crystal light valve for adjusting light and the liquid crystal light valve for display are disposed with a predetermined distance therebetween.

The liquid crystal light valve for adjusting light is schematically configured to include a liquid crystal panel and polarizing plates laminated on both sides of the liquid crystal panel. In the liquid crystal panel, a liquid crystal layer is interposed between a pair of glass substrates (light transmissive substrates), light transmissive electrodes are formed on the surfaces of the pair of glass substrates facing the liquid crystal layer, and alignment layers are formed on the surfaces of the light transmissive electrodes facing the liquid crystal layer.

In the case of the liquid crystal light valve for adjusting red light 17R2, when applying a voltage to the light transmissive electrode in response to a driving signal from a light adjusting liquid crystal driving unit 110*b* to be described later, it is possible to freely change the transmission rate in the range from a value close to 0% to 100% by changing the magnitude of the voltage to be applied. Thus, by changing the transmission rate in the range from a value close to 0% to 100%, the intensity (light amount) of the red light LR emitted from the liquid crystal light valve for adjusting red light 17R2 can be changed. Accordingly, by lowering the voltage to be applied according to an image to increase the transmission rate and accordingly increasing the intensity (light amount) of the red light LR or by increasing the voltage to be applied to reduce the transmission rate and accordingly reducing the intensity (light amount) of the red light LR, the intensity (light amount) of the red light LR is adjusted by the liquid crystal light valve for adjusting red light 17R2.

In the case of the liquid crystal light valve for adjusting green light 17G2, when applying a voltage to the light transmissive electrode in response to a driving signal from the light adjusting liquid crystal driving unit 110*b* to be described later, it is possible to freely change the transmission rate in the range from a value close to 0% to 100% by changing the magnitude of the voltage to be applied. Thus, by changing the transmission rate in the range from a value close to 0% to 100%, the intensity (light amount) of the green light LG emitted from the liquid crystal light valve for adjusting green light 17G2 can be changed. Therefore, the intensity (light amount) of the green light LG is adjusted by the liquid crystal light valve for adjusting green light 17G2.

In the case of the liquid crystal light valve for adjusting blue light 17B2, when applying a voltage to the light transmissive electrode in response to a driving signal from the light adjusting liquid crystal driving unit 110*b* to be described later, it is possible to freely change the transmission rate in the range from a value close to 0% to 100% by changing the magnitude of the voltage to be applied thereto. Thus, by changing the transmission rate in the range from a value close to 0% to 100%, the intensity (light amount) of the blue light LB emitted from the liquid crystal light valve for adjusting blue light 17B2 can be changed. Therefore, the intensity (light amount) of the blue light LB is adjusted by the liquid crystal light valve for adjusting blue light 17B2.

Three color light components modulated by the liquid crystal light valves for display 17R1, 17G1, and 17B1 are incident on the cross dichroic prism 18. This prism is formed by bonding four rectangular prisms to each other, and a dielectric multilayer film that reflects red light and a dielectric multilayer film that reflects blue light are formed in a cross shape on the inner surface thereof. By the dielectric multilayer films, three color light components are combined to form light that shows a color image. The combined light is projected onto a projection surface SC, such as a screen, by a projection lens 19 that is a projection optical system, and accordingly, an enlarged image is displayed.

Image sensors 51R, 51G, and 51B are provided on the incidence surfaces of the liquid crystal light valves for display 17R1, 17G1, and 17B1, respectively. Each of the image sensors 51R, 51G, and 51B is configured to include an imaging device, such as a charge coupled device (CCD) sensor or a complementary metal oxide semiconductor (CMOS) sensor. Although not shown, each of the image sensors 51R, 51G, and 51B is movable, and is formed such that switching between a state where all or a part of the incidence surface of each of the liquid crystal light valves for display 17R1, 17G1, and 17B1 is covered and a state where the incidence surface of each of the liquid crystal light valves for display 17R1, 17G1, and 17B1 is not covered can be performed by a sensor driving unit (not shown). When the projector 1 performs normal image projection, the image sensors 51R, 51G, and 51B do not cover the incidence surfaces of the liquid crystal light valves for display 17R1, 17G1, and 17B1.

The image sensors 51R, 51G, and 51B capture light (hereinafter, also referred to as "illumination light") reaching the incidence surfaces of the liquid crystal light valves for display 17R1, 17G1, and 17B1 from the liquid crystal light valves for adjusting light 17R2, 17G2, and 17B2. In addition, the image sensors 51R, 51G, and 51B generate image information indicating the captured image (hereinafter, also referred to as "illumination light image"), and output the image information to a detection unit 52 to be described later. The image sensors 51R, 51G, and 51B correspond to image sensor units.

In addition, the projector 1 includes a plurality of light adjusting elements, and includes a "lighting unit" that can independently control the amount of light emitted from the light adjusting elements. In the present embodiment, the lighting unit includes the light source device 11 and the liquid crystal light valve for adjusting light. Each "light adjusting element" provided in the lighting unit can adjust the amount of light incident on other optical elements, which are illumination targets, from the light adjusting element. In addition, the lighting unit can also independently control the amount of light emitted from each of the plurality of light adjusting elements. In the present embodiment, light adjusting pixels provided in the liquid crystal light valves for adjusting light 17R2, 17G2, and 17B2 correspond to the light adjusting elements.

Next, the control of the projector 1 of the present embodiment will be described.

In a known projector that does not have a light adjusting function, input image information (video signal) is supplied to the liquid crystal driving unit (liquid crystal panel driver) after appropriate correction processing is performed. However, in the case of a projector having a light adjusting function as in the present embodiment, it is necessary to control the intensity of each color light component based on image information.

Figure 2:
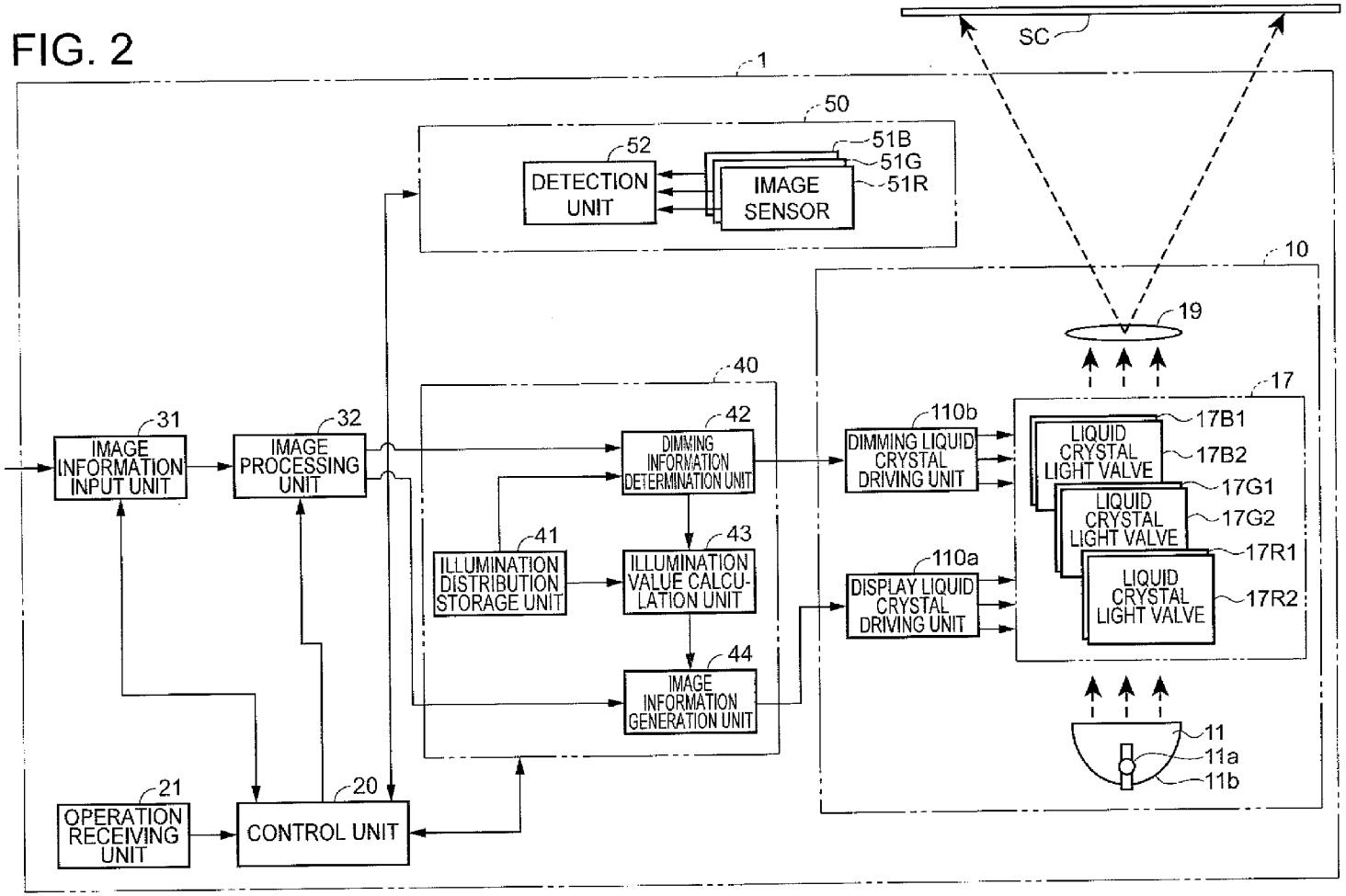
FIG. 2 is a block diagram showing the schematic configuration of the projector according to the first embodiment.

FIG. 2 is a block diagram showing the schematic configuration of the projector 1 according to the first embodiment.

As shown in FIG. 2, the projector 1 includes an image projection unit 10 as a display unit, a control unit 20, an operation receiving unit 21, an image information input unit 31, an image processing unit 32, a light valve control unit 40, an imaging detection unit 50, and the like.

The image projection unit 10 is configured to include the light source device 11, the three liquid crystal light valves for display 17R1, 17G1, and 17B1, the three liquid crystal light valves for adjusting light 17R2, 17G2, and 17B2, the projection lens 19 as a projection optical system, a display liquid crystal driving unit 110*a*, the light adjusting liquid crystal driving unit 110*b*, and the like. In addition, the liquid crystal light valves for display 17R1, 17G1, and 17B1 and the liquid crystal light valves for adjusting light 17R2, 17G2, and 17B2 are also referred to collectively as a liquid crystal light valve unit 17.

In the image projection unit 10, the amount of light emitted from the light source device 11 is adjusted by the liquid crystal light valves for adjusting light 17R2, 17G2, and 17B2, and the light after adjustment is modulated to image light by the liquid crystal light valves for display 17R1, 17G1, and 17B1. The image light is projected from the projection lens 19 so as to be displayed on the projection surface SC as an image.

The light emitted from the light source device 11 is converted into light with approximately uniform distribution by an integrator optical system, such as the fly-eye lenses 12*a* and 12*b*, and is separated into respective color light components of red (R), green (G), and blue (B), which are three primary colors of light, by a color separation optical system, such as the dichroic mirrors 14*a* and 14*b*. Then, the separated color light components are incident on the liquid crystal light valves for adjusting light 17R2, 17G2, and 17B2 and the liquid crystal light valves for display 17R1, 17G1, and 17B1.

The liquid crystal light valves for display 17R1, 17G1, and 17B1 and the liquid crystal light valves for adjusting light 17R2, 17G2, and 17B2 are formed by a liquid crystal panel in which liquid crystal is sealed between a pair of transparent substrates, for example. Each of the liquid crystal light valves for display 17R1, 17G1, and 17B1 and the liquid crystal light valves for adjusting light 17R2, 17G2, and 17B2 includes a rectangular pixel region where a plurality of display pixels and a plurality of light adjusting pixels (light adjusting elements) are arrayed in a matrix, so that it is possible to apply a driving voltage to a liquid crystal for each pixel.

When the light adjusting liquid crystal driving unit 110*b* applies a driving voltage corresponding to the light adjusting pixel value (the amount of light adjustment) to each light adjusting pixel, each light adjusting pixel is set to a light transmittance corresponding to the light adjusting pixel value. Therefore, the light emitted from the light source device 11 is output as light corresponding to the amount of light adjustment after the amount of light is adjusted by being transmitted through the pixel region of the liquid crystal light valves for adjusting light 17R2, 17G2, and 17B2. Light output from the liquid crystal light valves for adjusting light 17R2, 17G2, and 17B2 illuminates the liquid crystal light valves for display 17R1, 17G1, and 17B1, respectively.

When the display liquid crystal driving unit 110*a* applies a driving voltage corresponding to image information to each display pixel, each display pixel is set to a light transmittance corresponding to the image information. Therefore, the light emitted from the liquid crystal light valves for adjusting light 17R2, 17G2, and 17B2 is modulated by being transmitting through the pixel region of the liquid crystal light valves for display 17R1, 17G1, and 17B1, and image light corresponding to the image information is formed for each color light component. The formed image light components of the respective colors are combined by a color combining optical system (not shown in FIG. 2) for each pixel, thereby obtaining color image light. Then, the color image light is enlarged and projected by the projection lens 19.

The control unit 20 includes a central processing unit (CPU), a RAM used when storing various kinds of data or the like temporarily, a nonvolatile ROM, and the like. The CPU operates according to a control program stored in the ROM, thereby performing overall control of the operation of the projector 1. That is, the control unit 20 functions as a computer.

The operation receiving unit 21 includes a plurality of operation keys used when a user sends various kinds of instructions to the projector 1. Operation keys provided in the operation receiving unit 21 of the present embodiment include a power key for ON/OFF switching of a power supply, an input switching key for switching of an input video signal, a menu key for displaying a menu image for various settings, a direction key used when selecting an item in the menu image or the like, and a determination key for confirming the selected item.

When a user operates various operation keys of the operation receiving unit 21, the operation receiving unit 21 receives the operation and outputs a control signal corresponding to the operated operation key to the control unit 20. Then, when the control signal from the operation receiving unit 21 is input, the control unit 20 controls the operation of the projector 1 by performing processing based on the input control signal. Instead of the operation receiving unit 21 or in addition to the operation receiving unit 21, a remote control (not shown) that can be remotely controlled may be used as an input operation unit. In this case, the remote control transmits an operation signal such as an infrared ray corresponding to the operation content of the user, and a remote control signal receiving unit (not shown) receives the operation signal and transmits the operation signal to the control unit 20.

The image information input unit 31 includes a plurality of input terminals. Through the input terminals, image information in various formats is input from an external image supply apparatus (not shown), such as a video reproduction apparatus or a personal computer. The image information input unit 31 selects image information according to the instruction from the control unit 20, and outputs the selected image information to the image processing unit 32. The image information corresponds to first image information.

The image processing unit 32 converts the image information input from the image information input unit 31 into image information indicating the gradation of each display pixel. In addition, the image processing unit 32 performs image quality adjustment processing for adjusting the image quality, such as brightness, contrast, sharpness, and hue, for the converted image information according to the instruction from the control unit 20. In addition, the image processing unit 32 can also superimpose an onscreen display (OSD) image, such as a menu image, on the input image. Then, the image processing unit 32 outputs the processed image information to a light adjusting information determination unit 42 and an image information generation unit 44 of the light valve control unit 40. In addition, the image processing unit 32 can control the pixel value output to each pixel of the liquid crystal light valve for display and the liquid crystal light valve for adjusting light, and can output various kinds of image information, such as a test pattern image, a white image, and a black image that are different from the input image.

The imaging detection unit 50 is configured to include the image sensors 51R, 51G, and 51B and the detection unit 52. The imaging detection unit 50 corresponds to an illumination distribution detection unit.

The image sensors 51R, 51G, and 51B capture illumination light, which reaches the incidence surfaces of the liquid crystal light valves for display 17R1, 17G1, and 17B1 from the liquid crystal light valves for adjusting light 17R2, 17G2, and 17B2, according to the instruction from the control unit 20. Then, the image sensors 51R, 51G, and 51B generate image information indicating the illumination light image, and output the image information to the detection unit 52.

The detection unit 52 is configured to include a processing unit for image analysis and a memory (neither of which is shown). The detection unit 52 measures the brightness of the illumination reaching the image sensors 51R, 51G, and 51B by analyzing the image information of the illumination light image input from the image sensors 51R, 51G, and 51B. Then, the detection unit 52 detects the illumination distribution on each of the image sensors 51R, 51G, and 51B, in other words, the illumination distribution on each of the liquid crystal light valves for display 17R1, 17G1, and 17B1. In addition, the detection unit 52 notifies the control unit 20 of the information of the detected illumination distribution. Then, the control unit 20 stores the information of the illumination distribution in an illumination distribution storage unit 41. Here, previous information of the illumination distribution stored in the illumination distribution storage unit 41 is updated. In this case, the control unit 20 corresponds to an illumination distribution updating unit. In addition, the detection unit 52 corresponds to an information detection unit.

The light valve control unit 40 is configured to include the illumination distribution storage unit 41, the light adjusting information determination unit 42, an illumination value calculation unit 43, and the image information generation unit 44. The light valve control unit 40 corresponds to a light modulation control unit.

The illumination distribution storage unit 41 is configured to include a nonvolatile memory. The illumination distribution storage unit 41 stores the information of the illumination range and the intensity distribution, that is, information of illumination distribution when the light emitted from each light adjusting pixel of the liquid crystal light valves for adjusting light 17R2, 17G2, and 17B2 illuminates the liquid crystal light valves for display 17R1, 17G1, and 17B1. As a storage form of the information of the illumination distribution, a look-up table (LUT) may be used, or a function may be used. Here, the intensity distribution corresponds to the distribution information of the illumination intensity.

The illumination range and the intensity distribution are determined by the arrangement relationship between the liquid crystal light valve for adjusting light and the liquid crystal light valve for display. In addition, the information of the illumination range and the intensity distribution is stored for each color light component according to the arrangement relationship between the liquid crystal light valve for adjusting light and the liquid crystal light valve for display.

Here, the illumination range and the intensity distribution will be described.

Figure 3:
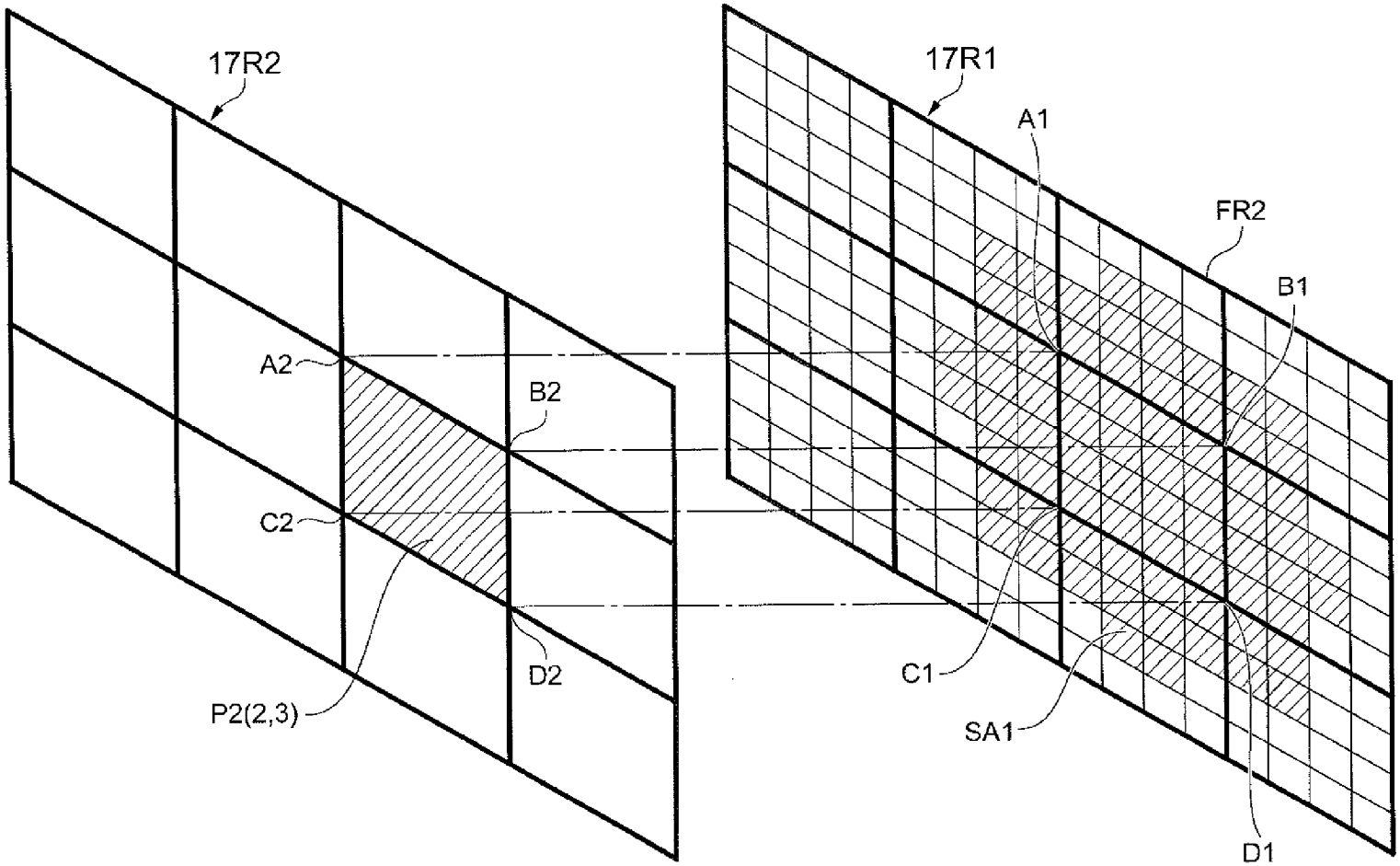
FIG. 3 is a perspective view showing the arrangement of liquid crystal light valves for adjusting light and liquid crystal light valves for display.

FIG. 3 is a perspective view showing the arrangement of the liquid crystal light valve for adjusting light 17R2 and the liquid crystal light valve for display 17R1.

Figure 4A:
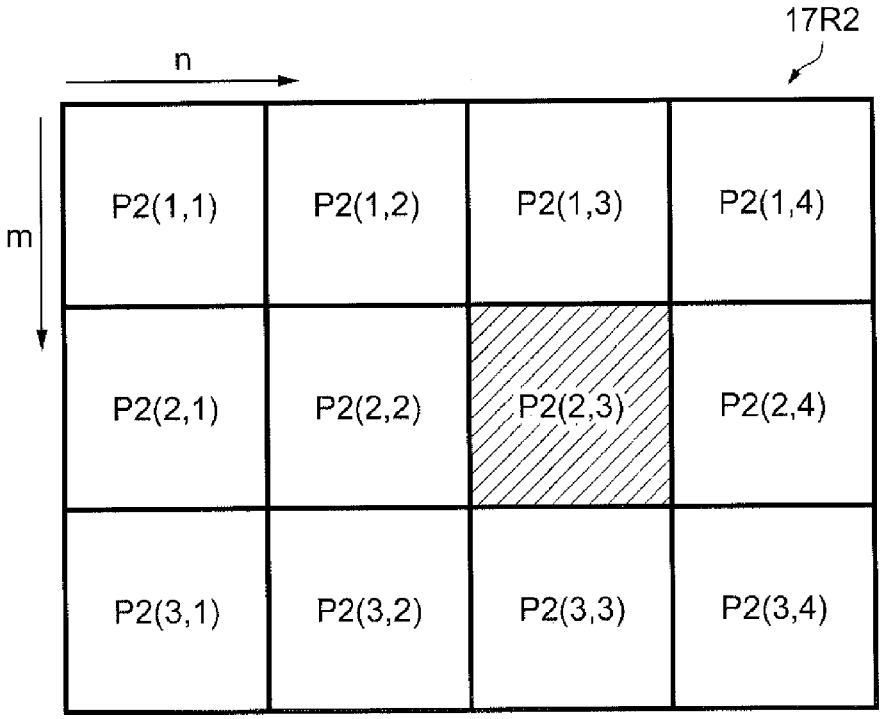
FIG. 4A is a front view of a liquid crystal light valve for adjusting light.
Figure 4B:
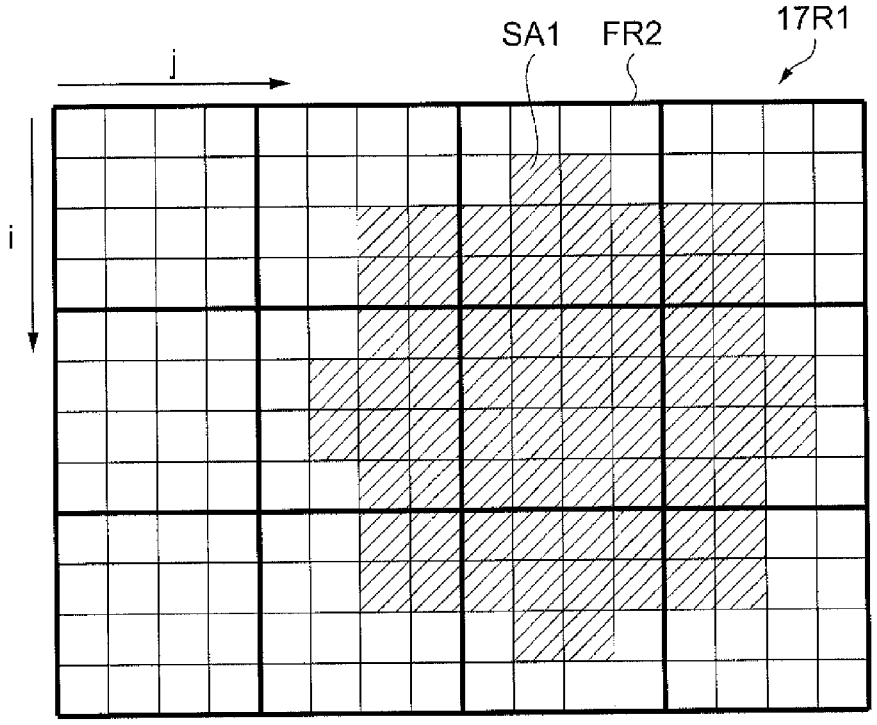
FIG. 4B is a front view of a liquid crystal light valve for display.

FIG. 4A is a front view of the liquid crystal light valve for adjusting light 17R2, and FIG. 4B is a front view of the liquid crystal light valve for display 17R1.

In FIGS. 3, 4A, and 4B, the liquid crystal light valve for adjusting light 17R2 and the liquid crystal light valve for display 17R1 are shown. Although not shown, the liquid crystal light valves for adjusting light 17G2 and 17B2 and the liquid crystal light valves for display 17G1 and 17B1 are assumed to have the same configuration. Explanation herein will be given using the liquid crystal light valve for adjusting light 17R2 and the liquid crystal light valve for display 17R1.

In the present embodiment, for the sake of simplicity, the liquid crystal light valve for adjusting light 17R2 is configured to have light adjusting pixels of 3 rows×4 columns. The coordinates of each light adjusting pixel are expressed as (m, n). In addition, the liquid crystal light valve for display 17R1 is configured to have display pixels of 12 rows×16 columns. The coordinates of each display pixel are expressed as (i, j). In addition, in the present embodiment, one light adjusting pixel of the liquid crystal light valve for adjusting light 17R2 is set to have a size corresponding to the 4×4 display pixels of the liquid crystal light valve for display 17B1. Accordingly, a thick line FR2 showing the position of the light adjusting pixel of the corresponding liquid crystal light valve for adjusting light 17R2 is displayed so as to be superimposed on the liquid crystal light valve for display 17R1 shown in FIGS. 3 and 4B.

Here, as shown in FIGS. 3, 4A, and 4B, one light adjusting pixel (in FIG. 3, a shaded portion having four corners A2, B2, C2, and D2) of the liquid crystal light valve for adjusting light 17R2 is assumed to be an observed light adjusting pixel P2(2, 3). Light having passed through the observed light adjusting pixel reaches not only 4×4 display pixels (a region having four corners A1, B1, C1, and D1) of the liquid crystal light valve for display 17R1 corresponding to the observed light adjusting pixel but also display pixels around the 4×4 display pixels. That is, display pixels around the observed light adjusting pixel are also illuminated due to the spread of light having passed through the observed light adjusting pixel.

Here, it is assumed that the light having passed through the observed light adjusting pixel P2(2, 3) of the liquid crystal light valve for adjusting light 17R2 reaches a region of the shaded portion of the liquid crystal light valve for display 17R1. The region of the shaded portion is assumed to be an illumination range SA1.

The illumination range SA1 and the intensity distribution in the illumination range SA1 shown in FIGS. 3, 4A, and 4B change with a distance between the liquid crystal light valve for adjusting light 17R2 and the liquid crystal light valve for display 17R1. For example, the illumination range SA1 and the intensity distribution in the illumination range SA1 shown in FIGS. 3, 4A, and 4B change due to an assembling error, a temporal change, or the like. For this reason, the projector 1 of the present embodiment has a function of detecting the illumination range SA1 and the intensity distribution. The initial value of the illumination range may be measured in advance during development of the products and be stored in the illumination distribution storage unit 41.

FIG. 5 is an explanatory view of the intensity distribution in the illumination range SA of the liquid crystal light valve for display. That is, this is an illustration of the information of the illumination distribution stored in the illumination distribution storage unit 41. As shown in FIG. 5, an illumination intensity S is written for each display pixel in the illumination range SA. The illumination intensity S increases as movement is made toward the center, and decreases as movement is made toward the periphery. The illumination intensity S is determined by the arrangement relationship between the liquid crystal light valve for adjusting light 17R2 and the liquid crystal light valve for display 17R1. Here, the illumination intensity S of each display pixel is expressed by a value of "0" or more and "1" or less.

Here, a function of detecting the illumination range SA1 and the intensity distribution will be described. In the present embodiment, the illumination range SA1 and the intensity distribution are detected using the image sensors 51R, 51G, and 51B.

When the projector 1 performs normal image projection, the image sensors 51R, 51G, and 51B do not cover the incidence surfaces of the liquid crystal light valves for display 17R1, 1761, and 17B1. When the user operates the operation receiving unit 21, such as an operation panel, provided in the projector 1 to display a menu image or the like and select an illumination distribution detection mode (not shown) that is a mode for detecting the illumination distribution, the image sensors 51R, 51G, and 51B cover the incidence surfaces of the liquid crystal light valves for display 17R1, 17G1, and 17B1 to start the detection of the illumination range SA1 and the intensity distribution.

Figure 6:
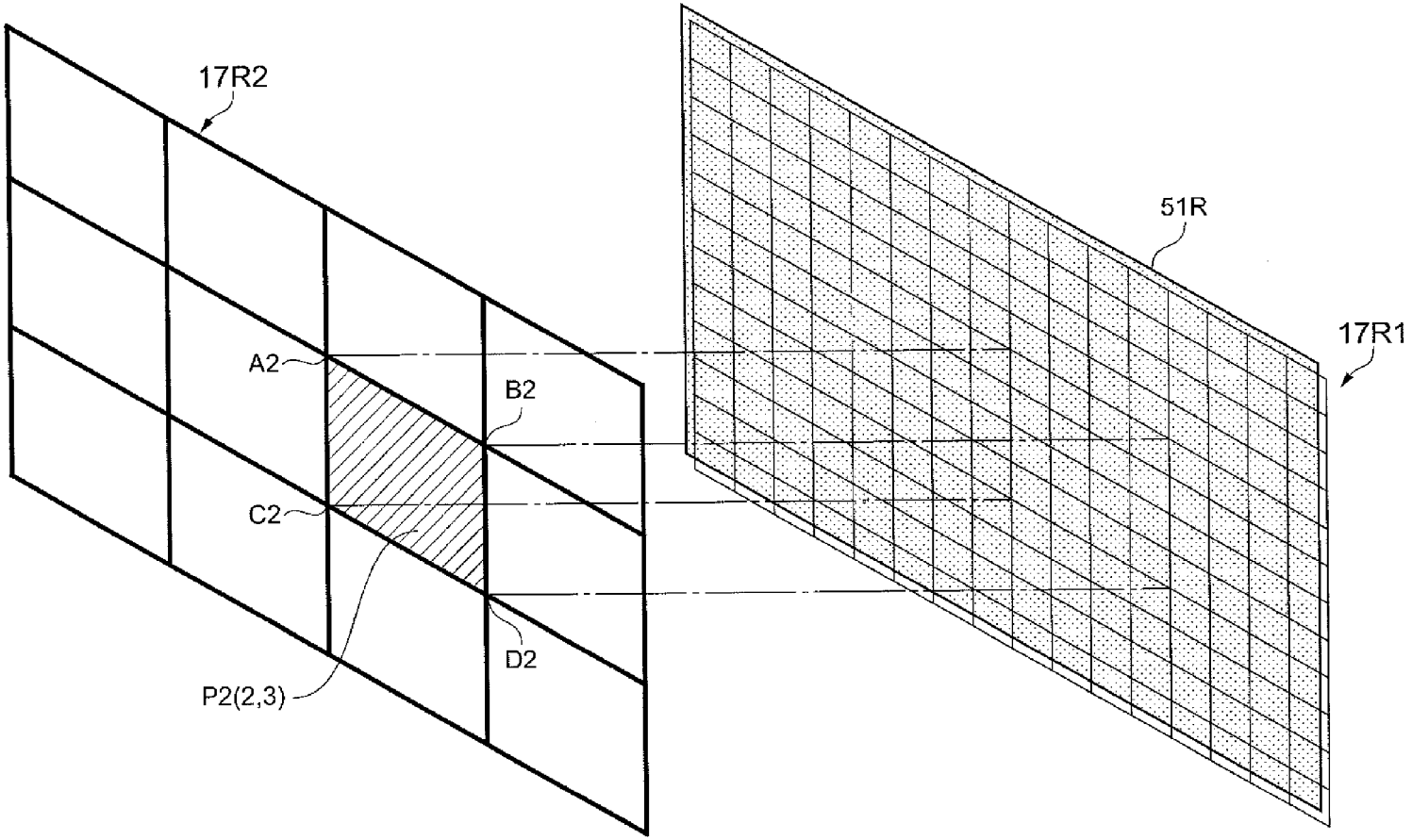
FIG. 6 is a perspective view showing a state where an image sensor covers the incidence surface of the liquid crystal light valve for display.

FIG. 6 is a perspective view showing a state where the image sensor 51R covers the incidence surface of the liquid crystal light valve for display 17R1.

As shown in FIG. 6, in the illumination distribution detection mode, the image sensor 51R detects a display pixel of the liquid crystal light valve for display 17R1 illuminated by light emitted from a predetermined light adjusting pixel (in the present embodiment, P2(2, 3)) of the liquid crystal light valve for adjusting light 17R2. Although not shown in FIG. 6, illumination light having passed through the light adjusting pixel P2(2, 3) also spreads to illuminate display pixels around a display pixel corresponding to the light adjusting pixel.

Here, a process of detecting the illumination range SA1 and the intensity distribution in the illumination distribution detection mode will be described.

Figure 7:
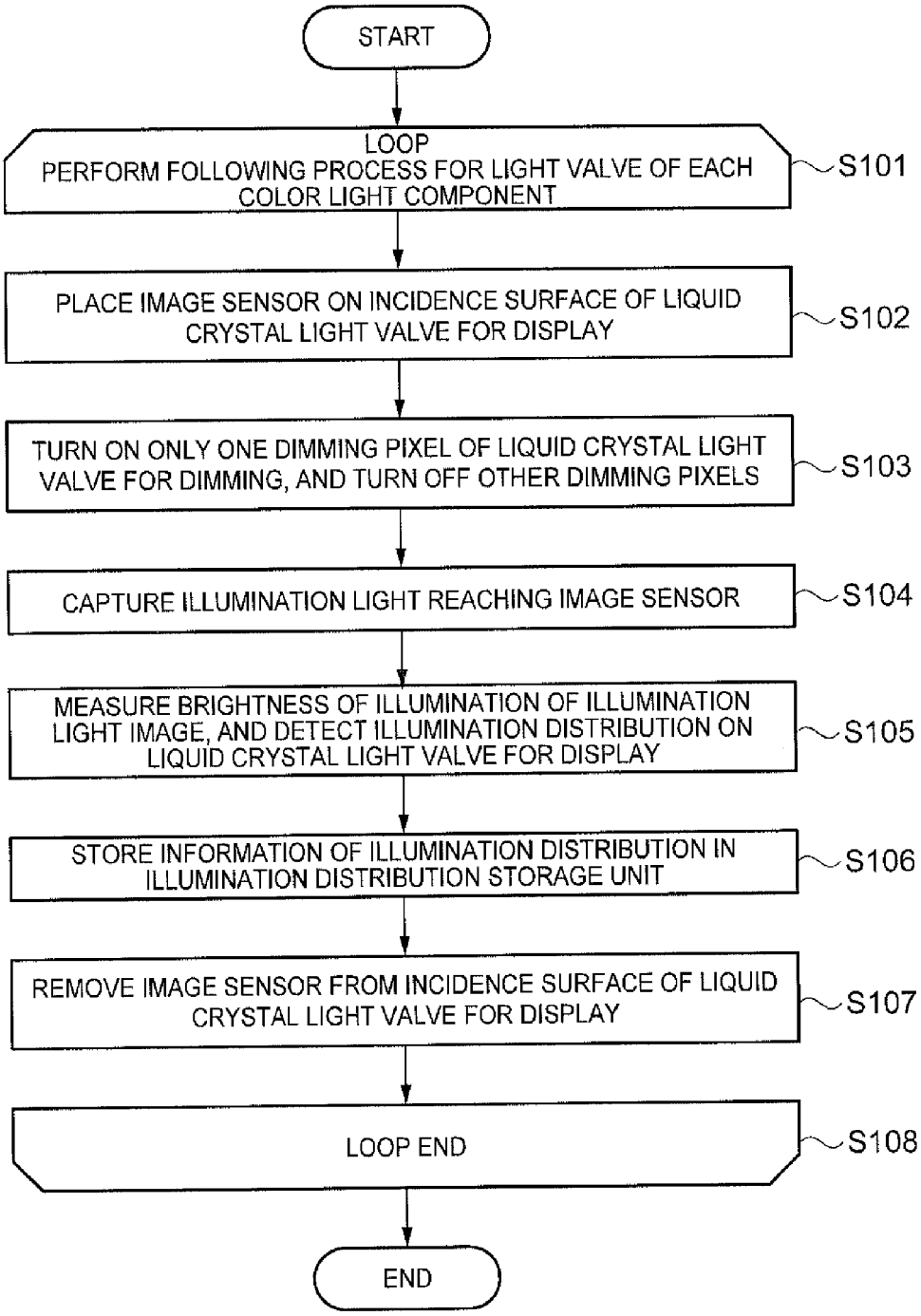
FIG. 7 is a flowchart of the illumination distribution detection process that the projector performs in the illumination distribution detection mode.

FIG. 7 is a flowchart of the process for detecting the illumination distribution (illumination distribution detection process) that the projector 1 performs in the illumination distribution detection mode.

When the illumination distribution detection mode is started, the imaging detection unit 50 performs a sequential process of steps S101 to S108 for the light valve of each of the color light components according to the instruction from the control unit 20 (loop) (step S101).

The control unit 20 gives an instruction to a sensor driving unit (not shown) so that image sensors are placed on the incidence surface of the liquid crystal light valve for display (step S102). The control unit 20 gives an instruction to the image processing unit 32 so that only one light adjusting pixel of the liquid crystal light valve for adjusting light is turned on and the other light adjusting pixels are turned off (step S103).

According to the instruction from the control unit 20, the image sensors capture illumination light reaching them (step S104). According to the instruction from the control unit 20, the detection unit 52 measures the brightness of the illumination in the illumination light image, and detects the illumination distribution (the illumination range SA and the illumination intensity S) on the liquid crystal light valve for display (step S105).

The detection unit 52 notifies the control unit 20 of the information of the illumination distribution, and the control unit 20 stores the information of the illumination distribution in the illumination distribution storage unit 41 (step S106). That is, the information of the illumination distribution previously stored in the illumination distribution storage unit 41 is updated. The control unit 20 gives an instruction to the sensor driving unit so that the image sensors are removed from the incidence surface of the liquid crystal light valve for display (step S107). Then, the process returns to step S101 to perform the process for the next light valve (step S108).

Referring back to FIG. 2, for each light adjusting pixel, the light adjusting information determination unit 42 specifies the illumination range of the liquid crystal light valve for display based on the illumination range SA stored in the illumination distribution storage unit 41, and determines the amount of light adjustment of the light adjusting pixel of the liquid crystal light valve for adjusting light based on the feature quantity of the first image information corresponding to the display pixel in the illumination range SA. In the present embodiment, the maximum value of the first image information corresponding to the display pixel included in the illumination range SA of the light adjusting pixel is set as the feature quantity.

In addition, the projector 1 may perform various kinds of image processing on the first image information. In this case, the light adjusting information determination unit 42 may determine the feature quantity based on the first image information after various kinds of image processing. For example, when the number of pixels of the first image information does not match the number of pixels of the liquid crystal light valves for display 17R1, 17G1, and 17B1, the projector 1 may perform a resizing process (resolution conversion process) on the first image information so that the number of pixels of the first image information matches the number of pixels of the liquid crystal light valves for display 17R1, 17G1, and 17B1. In such a case, image information after the resizing process may be defined as the first image information. In this case, the light adjusting information determination unit 42 may determine the feature quantity based on the image information after the resizing process.

Here, assuming that the gradation (pixel value) of the first image information corresponding to a display pixel (i, j) included in an illumination range SA(m, n) by a light adjusting pixel (m, n) is In_P1(*i, j*), the following Expression (1) is satisfied.

$$0 \le \text{In_}P1(i,j) \le 1, (i,j) \in SA(m,n) \quad (1)$$

In addition, assuming that the maximum value (feature quantity) of the first image information corresponding to the light adjusting pixel (m, n) is F(m, n) the following Expression (2) is satisfied.

$$F(m,n) = \max(\text{In_}P1(i,j)) \quad (2)$$

In addition, as shown in the following Expression (3), the maximum value (feature quantity) of the first image information corresponding to the light adjusting pixel (m, n) is assumed to be the amount of light adjustment (pixel value) A(m, n) of the light adjusting pixel (m, n).

$$A(m,n) = F(m,n) \quad (3)$$

The illumination value calculation unit 43 calculates the illumination value of light reaching each display pixel of the liquid crystal light valve for display 17R1 based on the amount of light adjustment (pixel value) of the light adjusting pixel of the liquid crystal light valve for adjusting light and the distribution information of the illumination intensity S in the liquid crystal light valve for display.

First, the illumination value calculation unit 43 extracts a light adjusting pixel, for which illumination light reaches an observed display pixel of the liquid crystal light valve for display, from all of the light adjusting pixels of the liquid crystal light valve for adjusting light. Specifically, for example, for each adjusting light pixel of the liquid crystal light valve for adjusting light 17R2, the illumination value calculation unit 43 determines whether or not an observed display pixel is included in the illumination range SA in which the light having passed through each light adjusting pixel reaches the liquid crystal light valve for display 17R1, and extracts the light adjusting pixel when an observed display pixel is included in the illumination range SA.

Then, the illumination value calculation unit 43 calculates the brightness with which the observed display pixel of the liquid crystal light valve for display 17R1 is illuminated by each light adjusting pixel extracted on the liquid crystal light valve for adjusting light 17R2. Here, the brightness necessary to illuminate the liquid crystal light valve for display 17R1 by each light adjusting pixel of the liquid crystal light valve for adjusting light 17R2 can be calculated by multiplying the amount of light adjustment A(m, n) of each light adjusting pixel by the distribution of the illumination intensity S.

Assuming that the brightness with which the observed display pixel (i, j) of the liquid crystal light valve for display 17R1 is illuminated is L(i, j), L(i, j) can be calculated with the sum of light that reaches the observed display pixel from each light adjusting pixel extracted from the liquid crystal light valve for adjusting light 17R2. Here, the illumination intensity S(i, j, m, n) indicates an illumination intensity corresponding to the positional relationship between the light adjusting pixel P2(*m, n*) and the observed display pixel P1(*i, j*) of the liquid crystal light valve for display 17R1. The brightness L(i, j) with which the observed display pixel (i, j) is illuminated is expressed by the following Expression (4).

$$L(i,j)=\Sigma A(m,n)\times S(i,j,m,n) \quad (4)$$

Here, $0 \leq L(i, j) \leq 1$. In addition, m, n∈SB(i, j).

SB(i, j) is a set of light adjusting pixels (m, n) that illuminate the observed display pixel (i, j), and Σ(sigma) for all light adjusting pixels (m, n) included in the SB(i, j) is calculated.

The image information generation unit 44 calculates a pixel signal of the observed display pixel, that is, second image information based on the first image information input from the image processing unit 32 and the illumination value L(i, j) of light reaching the observed display pixel of the liquid crystal light valve for display 17R1, which has been calculated by the illumination value calculation unit 43. Here, the image information generation unit 44 sets a value, which is obtained by dividing the first image information corresponding to the observed display pixel by the brightness with which the observed display pixel is illuminated, as a pixel signal (second image information (pixel value)) Out_P1(*i, j*) of the observed display pixel. Then, Out_P1(*i, j*) is expressed by the following Expression (5).

$$\text{Out_}P1(i,j)=\text{In_}P1(i,j)/L(i,j) \quad (5)$$

Here, $0 \leq \text{Out_P1}(i, j) \leq 1$.

In addition, as described above, in the present embodiment, a value, such as a pixel value or the brightness, is expressed as a gradation of "0" or more and "1" or less.

The light adjusting liquid crystal driving unit 110*b* drives the liquid crystal light valves for adjusting light 17R2, 17G2, and 17B2 according to the amount of light adjustment A(m, n) input from the light adjusting information determination unit 42, and the display liquid crystal driving unit 110*a* drives the liquid crystal light valves for display 17R1, 17G1, and 17B1 according to second image information Out_P1(*i, j*) input from the image information generation unit 44. Accordingly, the light emitted from the light source device 11 is adjusted (dimmed) by the liquid crystal light valves for adjusting light 17R2, 17G2, and 17B2, and is modulated to image light corresponding to the second image information by the liquid crystal light valves for display 17R1, 17G1, and 17B1. This image light is projected from the projection lens 19.

Next, a process that the light valve control unit 40 of the projector 1 performs for each frame or each sub-frame will be described with reference to the flowchart.

Figure 8:
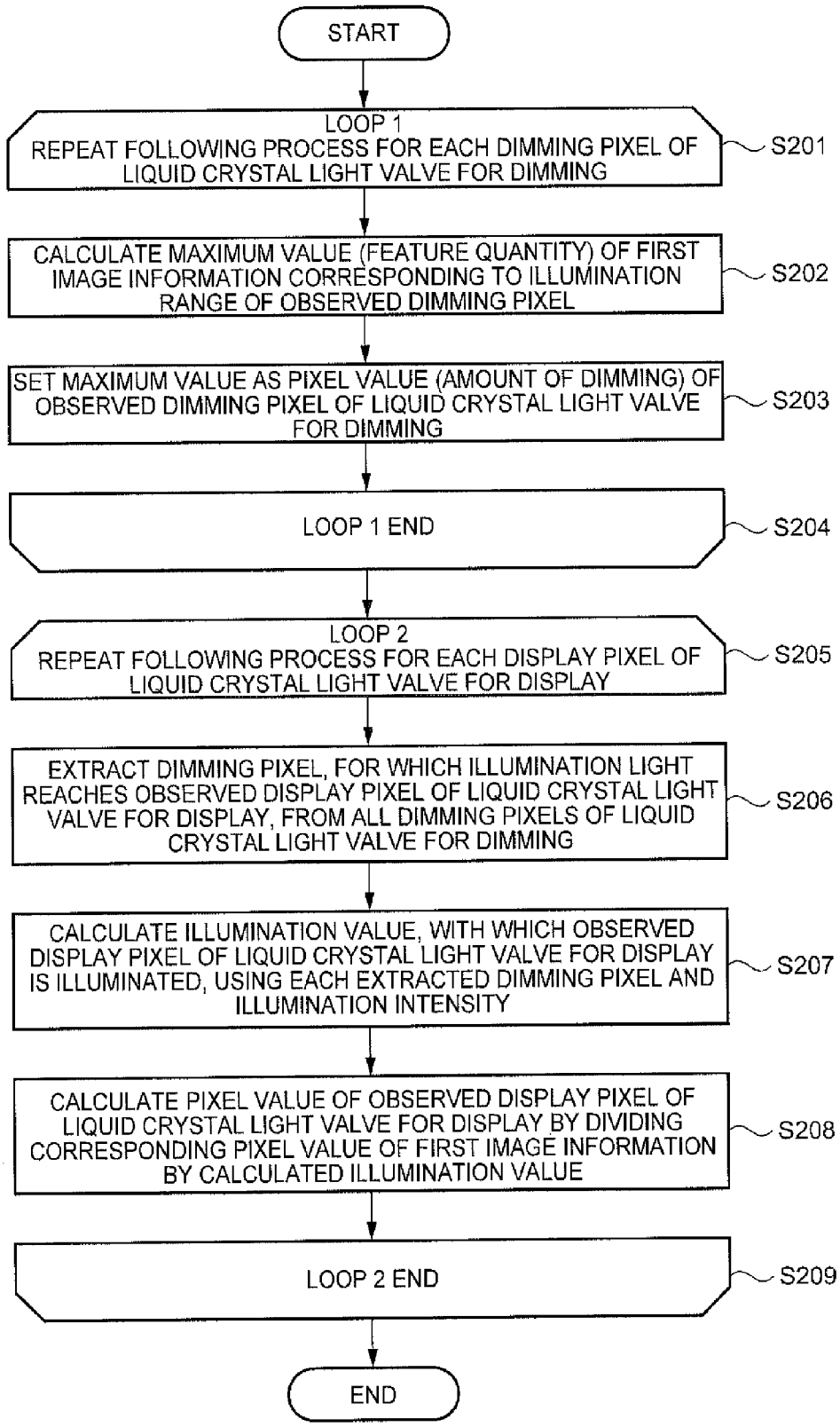
FIG. 8 is a flowchart of the process performed by a light valve control unit of the projector.

FIG. 8 is a flowchart of the process performed by the light valve control unit 40 of the projector 1.

The light valve control unit 40 repeats the process of steps S201 to S204 for each light adjusting pixel of the liquid crystal light valve for adjusting light (loop 1) step S201).

First, the light adjusting information determination unit 42 calculates a maximum value (feature quantity) F(m, n) of the first image information corresponding to the display pixel in the illumination range SA of the observed light adjusting pixel (step S202). Then, the light adjusting information determination unit 42 sets the maximum value as a pixel value (the amount of light adjustment) A(m, n) of the observed light adjusting pixel of the liquid crystal light valve for adjusting light (step S203). Then, the process returns to step S201 to repeat the process with the next light adjusting pixel as an observed light adjusting pixel (step S204).

Thus, for all of the adjusting light pixels of the liquid crystal light valve for adjusting light, the pixel value (the amount of light adjustment) A(m, n) is determined. This pixel value (the amount of light adjustment) corresponds to light adjusting information.

Then, the light valve control unit 40 repeats a process of steps S205 to S209 for each display pixel of the liquid crystal light valve for display (loop 2) step S205).

First, the illumination value calculation unit 43 extracts a light adjusting pixel, for which illumination light reaches the observed display pixel (i, j) of the liquid crystal light valve for display, from all of the light adjusting pixels of the liquid crystal light valve for adjusting light (step S206). Then, the illumination value L(i, j) with which the observed display pixel of the liquid crystal light valve for display is illuminated is calculated using each extracted light adjusting pixel and the illumination intensity S(i, j, m, n) (step S207).

The image information generation unit 44 calculates the pixel value (second image information) Out_P1(*i, j*), which is set for the observed display pixel of the liquid crystal light valve for display, by dividing the corresponding pixel value of the first image information by the calculated illumination value (step S208). Then, the process returns to step S205 to repeat the process with the next display pixel as an observed display pixel (step S209).

When the process is completed for all of the display pixels, the light valve control unit 40 ends the process performed for each frame or each sub-frame. Then, this process is repeatedly performed for the next frame or sub-frame. Each light adjusting pixel value (the amount of light adjustment) A(m, n) of the liquid crystal light valve for adjusting light and each display pixel value (second image information) Out_P1(*i, j*) of the liquid crystal light valve for display, which have been generated by this process, are output to the light adjusting liquid crystal driving unit 110*b* and the display liquid crystal driving unit 110*a*, respectively. Then, the liquid crystal light valve for adjusting light and the liquid crystal light valve for display are driven according to the pixel value.

According to the embodiment described above, the following effects are obtained.

(1) In the projector 1, the illumination range SA and the illumination intensity S when the light having passed through the light adjusting pixels of the liquid crystal light valves for adjusting light 17R2, 17G2, and 17B2 illuminates the display pixels of the liquid crystal light valves for display 17R1, 17G1, and 17B1 are stored in the illumination distribution storage unit 41 as information of the illumination distribution. The illumination range SA and the illumination intensity S are determined by the arrangement relationship between each liquid crystal light valve for adjusting light and the corresponding liquid crystal light valve for display. The illumination range SA and the illumination intensity S are measured in advance during development of the products and are stored in the illumination distribution storage unit 41. However, the illumination range SA and the illumination intensity S change due to an assembling error, a temporal change, or the like of the product. In the projector 1, it is possible to rewrite the information stored in the illumination distribution storage unit 41 using the image sensors 51R, 51G, and 51B and the detection unit 52 of the imaging detection unit 50 and the control unit 20. Therefore, it is advantageous because, even when the illumination distribution changes from the initial state, the projector 1 can realize accurate gradation reproduction by rewriting the illumination range SA and the illumination intensity S stored in the illumination distribution storage unit 41, that is, the information of the illumination distribution.

(2) The projector 1 performs light adjustment by using the maximum value of the pixel value of the first image information corresponding to the display pixel in the illumination range on the liquid crystal light valve for display, which is illuminated by the light having passed through the light adjusting pixel of the liquid crystal light valve for adjusting light, as a pixel value (that is, the amount of light adjustment (light adjusting information)) of the light adjusting pixel of the liquid crystal light valve for adjusting light. In the illumination distribution detection mode, the illumination distribution detection unit (in the present embodiment, the image sensors 51R, 51G, and 51B of the imaging detection unit 50) detects the illumination distribution when the light emitted from each light adjusting pixel of the liquid crystal light valves for adjusting light 17R2, 17G2, and 17B2 illuminates each display pixel of the liquid crystal light valves for display 17R1, 17G1, and 17B1. The control unit 20 updates the information of the illumination range of the illumination distribution storage unit 41 based on the information of the detected illumination distribution. Accordingly, it is advantageous because, even when the illumination distribution on the liquid crystal light valves for display 17R1, 17G1, and 17B1 changes due to an assembling error, a temporal change, or the like, the liquid crystal light valves for adjusting light 17R2, 17G2, and 17B2 can perform light adjustment in consideration of the feature quantity (maximum value) of the first pixel information corresponding to the updated illumination range by updating the information of the illumination range of the illumination distribution storage unit 41.

(3) In the projector 1, the control unit 20 (illumination distribution updating unit) updates the distribution information of the illumination intensity of the illumination distribution storage unit 41 based on the information of the illumination distribution detected by the illumination distribution detection unit (in the present embodiment, the image sensors 51R, 51G, and 51B of the imaging detection unit 50). The illumination value calculation unit 43 calculates the illumination value of the light reaching each display pixel of the liquid crystal light valves for display 17R1, 17G1, and 17B1 based on the light adjusting information and the updated distribution information of the illumination intensity. The image information generation unit 44 generates the second image information, which is to be set in the liquid crystal light valves for display 17R1, 17G1, and 17B1, by dividing the first image information by the illumination value for each display pixel. Therefore, it is possible to generate the second image information, which is to be set in the liquid crystal light valves for display 17R1, 17G1, and 17B1, in consideration of the distribution of the illumination intensity of the illumination light from the liquid crystal light valves for adjusting light 17R2, 17G2, and 17B2. That is, it is possible to realize a gradation expression which is almost faithful to the input first image information while taking the illumination light into consideration. In addition, it is possible to generate the pixel information (pixel value) set for the display pixel in consideration of a change in the illumination distribution due to an assembling error, a temporal change, or the like, thus it is advantageous.

(4) In the projector 1, a value obtained by dividing the first image information by the illumination value is set as the second image information. Therefore, also in the second image information, it is possible to maintain the brightness of the first image information almost equally while taking into consideration the brightness control based on the light adjustment of the liquid crystal light valve for adjusting light, thus it is advantageous.

(5) In the projector 1, the feature quantity of the first image information is set to the maximum value of the pixel value of the first image information in the updated illumination range. Therefore, since it is possible to suppress a reduction in the brightness of the illumination value at which the display pixel of the liquid crystal light valve for display is illuminated, it is possible to perform light adjustment that can almost reproduce the brightness of the input first image information, thus it is advantageous.

Second Embodiment

Hereinafter, as a second embodiment, a projector capable of detecting a change in the illumination distribution in the liquid crystal light valve for display by capturing a projected image will be described with reference to the accompanying diagrams.

FIG. 1 of the first embodiment from which the image sensors 51R, 51G, and 51B are excluded corresponds to the schematic diagram showing an optical unit of the projector of the second embodiment. Components other than the image sensors 51R, 51G, and 51B are the same as those shown in FIG. 1. Therefore, explanation thereof will be omitted.

Figure 9:
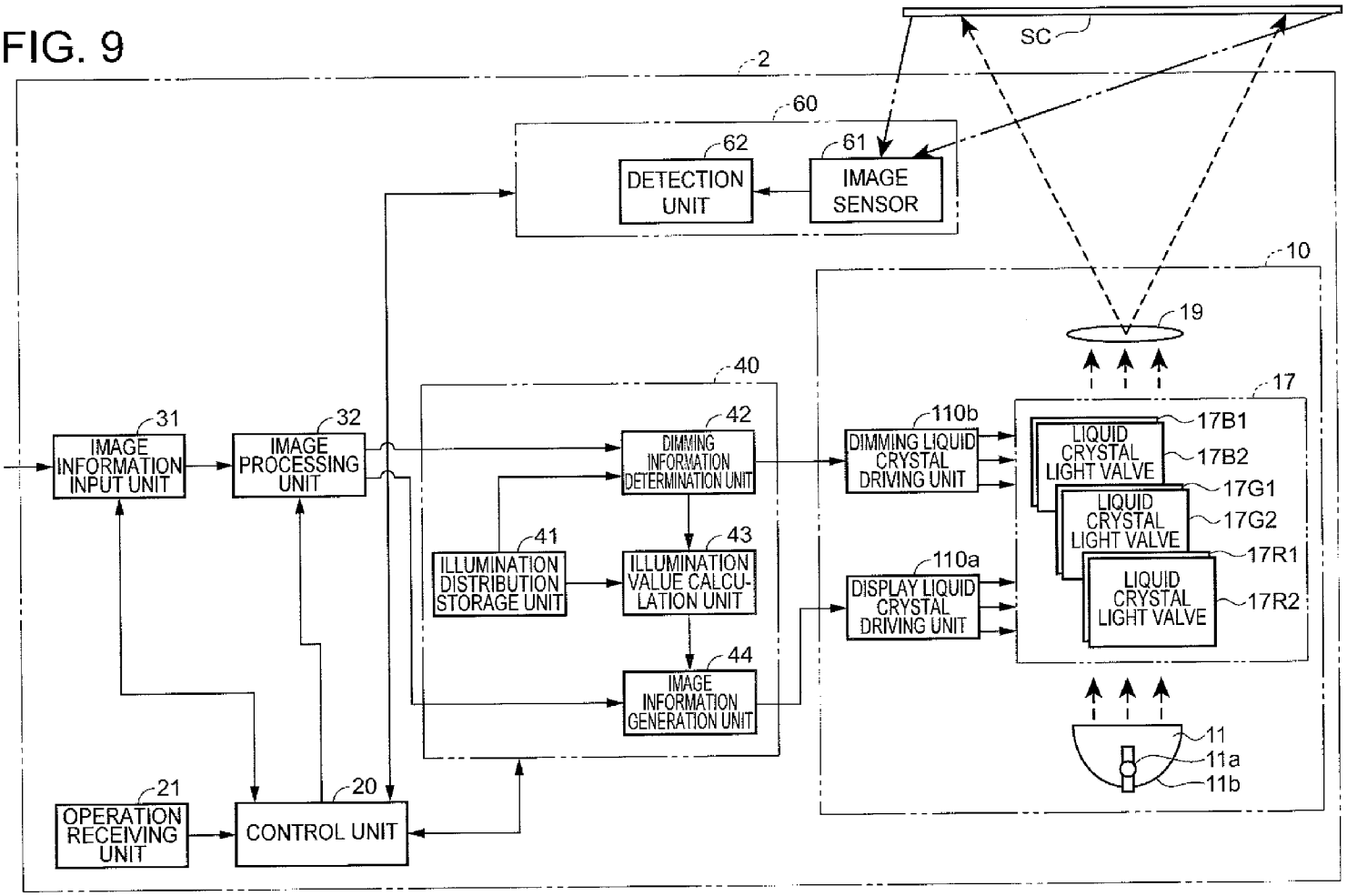
FIG. 9 is a block diagram showing the schematic configuration of a projector according to a second embodiment.

FIG. 9 is a block diagram showing the schematic configuration of a projector 2 according to the second embodiment.

As shown in FIG. 9, the configuration of the projector 2 is the same as that of the projector 1 (refer to FIG. 2) of the first embodiment except for an imaging detection unit 60. Therefore, explanation excluding that of the imaging detection unit 60 will be omitted. Here, for the same components as in the first embodiment, the same reference numerals are used.

The imaging detection unit 60 is configured to include an image sensor 61 and a detection unit 62 as an information detection unit. The imaging detection unit 60 is controlled by the control unit 20. The imaging detection unit 60 detects the illumination distribution when the liquid crystal light valve for adjusting light illuminates the liquid crystal light valve for display by imaging the projection surface SC and analyzing the image. The imaging detection unit 60 corresponds to an illumination distribution detection unit, and the image sensor 61 corresponds to an image sensor unit.

The image sensor 61 includes an imaging device (not shown), such as a CCD sensor or a CMOS sensor, and an imaging lens (not shown) for imaging the light emitted from an imaging target on the imaging device. The image sensor 61 is disposed near the projection lens 19 of the projector 2, and images a range including an image projected onto the projection surface SC (hereinafter, also referred to as a "projected image") according to the instruction from the control unit 20. Then, the image sensor 61 generates image information indicating the captured image (hereinafter, also referred to as a "captured image"), and outputs the image information to the detection unit 62.

The detection unit 62 is configured to include a processing unit for image analysis and a memory (neither of which is shown). The detection unit 62 measures the brightness of the illumination in the image information captured by the image sensor 61 by analyzing the image information of the captured image input from the image sensor 61. Then, the detection unit 62 detects the illumination distribution of the image information, and recognizes the illumination distribution as the illumination distribution on the liquid crystal light valve for display. The detection unit 62 notifies the control unit 20 of the information of the illumination distribution, and the control unit 20 stores the information of the illumination distribution in the illumination distribution storage unit 41. Here, previous information of the illumination distribution stored in the illumination distribution storage unit 41 is updated.

Here, a function of detecting the information of the illumination distribution, that is, the illumination range SA1 and the intensity distribution will be described. In the present embodiment, the illumination range SA1 and the intensity distribution are detected using the image sensor 61.

When the user operates the operation receiving unit 21, such as an operation panel, provided in the projector 2 to display a menu image or the like and select an illumination distribution detection mode (not shown), the imaging detection unit 60 starts an illumination distribution detection mode in which the illumination range SA1 and the intensity distribution are detected.

Here, a process of detecting the illumination range SA1 and the intensity distribution in the illumination distribution detection mode will be described.

Figure 10:
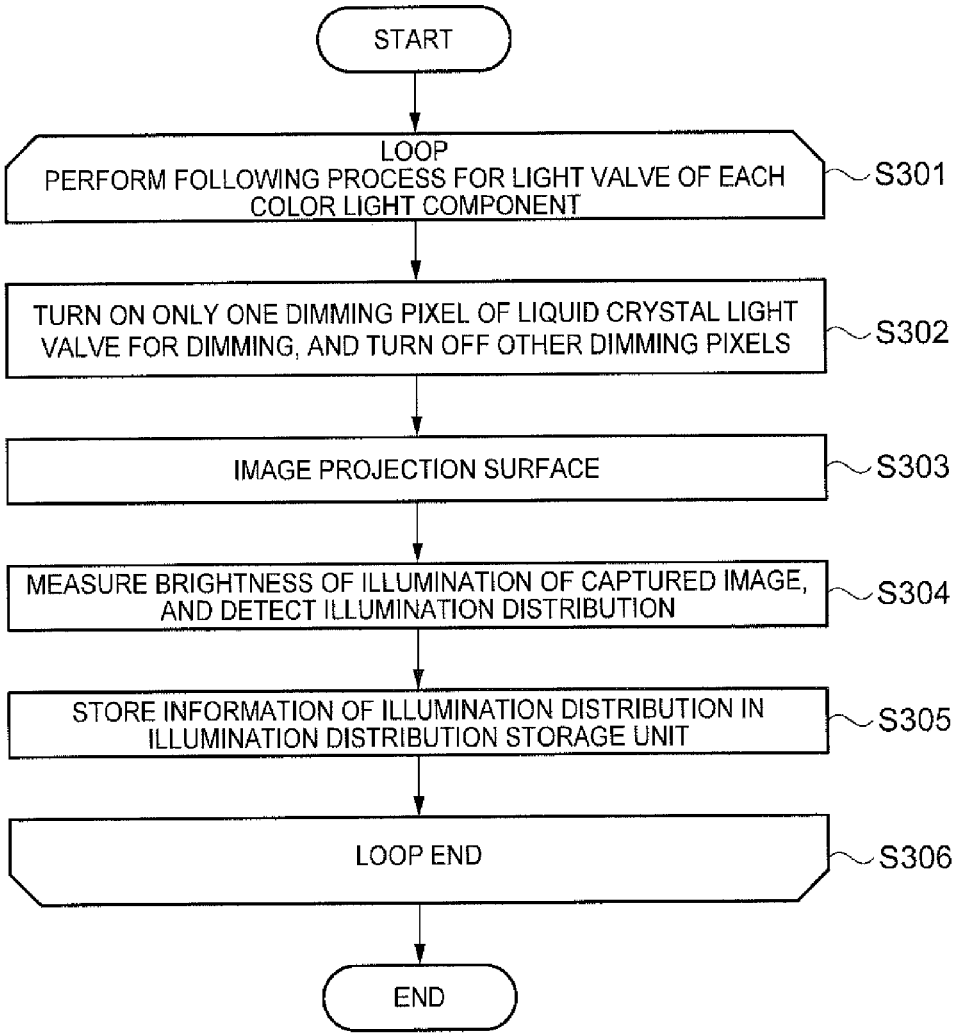
FIG. 10 is a flowchart of the illumination distribution detection process that the projector performs in the illumination distribution detection mode.

FIG. 10 is a flowchart of the illumination distribution detection process that the projector 2 performs in the illumination distribution detection mode.

When the illumination distribution detection mode is started, the imaging detection unit 60 performs the process of steps S301 to S306 sequentially for the light valve of each color light component according to the instruction from the control unit 20 (loop) (step S301). When performing the process for one color light component, it is assumed that projection from the light valves of other color light components is blocked. That is, black projection is performed.

The control unit 20 gives an instruction to the image processing unit 32 so that only one light adjusting pixel of the liquid crystal light valve for adjusting light is turned on and the other light adjusting pixels are turned off (step S302). According to the instruction from the control unit 20, the image sensor 61 images the projection surface SC (step S303). According to the instruction from the control unit 20, the detection unit 62 measures the brightness of the illumination in the captured image, and detects the illumination distribution (the illumination range SA and the illumination intensity S) (step S304).

The detection unit 62 notifies the control unit 20 of the information of the illumination distribution, and the control unit 20 stores the information of the illumination distribution of the corresponding color light component in the illumination distribution storage unit 41 (step S305). That is, the information of the illumination distribution previously stored in the illumination distribution storage unit 41 is updated. Then, the process returns to step S301 to perform the process for the light valve of the next color light component (step S306).

Based on the information of the illumination distribution calculated as described above, the light valve control unit 40 of the projector 2 performs light valve control corresponding to the illumination distribution. Light valve control processing corresponding to the illumination distribution is the same as that in the first embodiment.

According to the second embodiment described above, the same effects as the effects (2), (3), (4), and (5) of the first embodiment can also be obtained. Other effects are obtained as follows.

(1) In the projector 2, the illumination range SA and the illumination intensity S when the light having passed through the light adjusting pixels of the liquid crystal light valves for adjusting light 17R2, 17G2, and 17B2 illuminates the display pixels of the liquid crystal light valves for display 17R1, 17G1, and are stored in the illumination distribution storage unit 41 as information of the illumination distribution. The illumination range SA and the illumination intensity S are determined by the arrangement relationship between each liquid crystal light valve for adjusting light and the corresponding liquid crystal light valve for display. The illumination range SA and the illumination intensity S are measured in advance during development of the products and are stored in the illumination distribution storage unit 41. However, the illumination range SA and the illumination intensity S change due to an assembling error, a temporal change, or the like of the product. In the projector 2, the image sensor 61 and the detection unit 62 of the imaging detection unit 60 detect the information of the illumination distribution and notify the control unit 20 of the detected information of the illumination distribution. In addition, the control unit 20 can rewrite the information stored in the illumination distribution storage unit 41. Thus, it is advantageous because, even when the illumination distribution changes from the initial state, the projector 2 can realize accurate gradation reproduction by rewriting the illumination range SA and the illumination intensity S stored in the illumination distribution storage unit 41, that is, the illumination distribution.

In addition, the illumination distribution detection method using the image sensor 61 of the projector 2 described in the present embodiment can be applied to a projector (interactive system) having an interactive function, thus it is advantageous.

Third Embodiment

Hereinafter, as a third embodiment, a projector capable of detecting the illumination distribution by measuring a change in the distance between the liquid crystal light valve for adjusting light and the liquid crystal light valve for display will be described with reference to the accompanying diagrams.

FIG. 1 of the first embodiment from which the image sensors 51R, 51G, and 51B are excluded corresponds to the schematic diagram showing an optical unit of the projector of the third embodiment. In addition, distance sensors 71R, 71G, and 71B are provided so as to measure the distance between the liquid crystal light valves for display 17R1, 17G1, 17B1 and the liquid crystal light valve for adjusting light 17R2, 17G2, and 17B2, but illustration thereof is omitted herein. The other configuration is the same as that shown in FIG. 1. Therefore, explanation thereof will be omitted.

Figure 11:
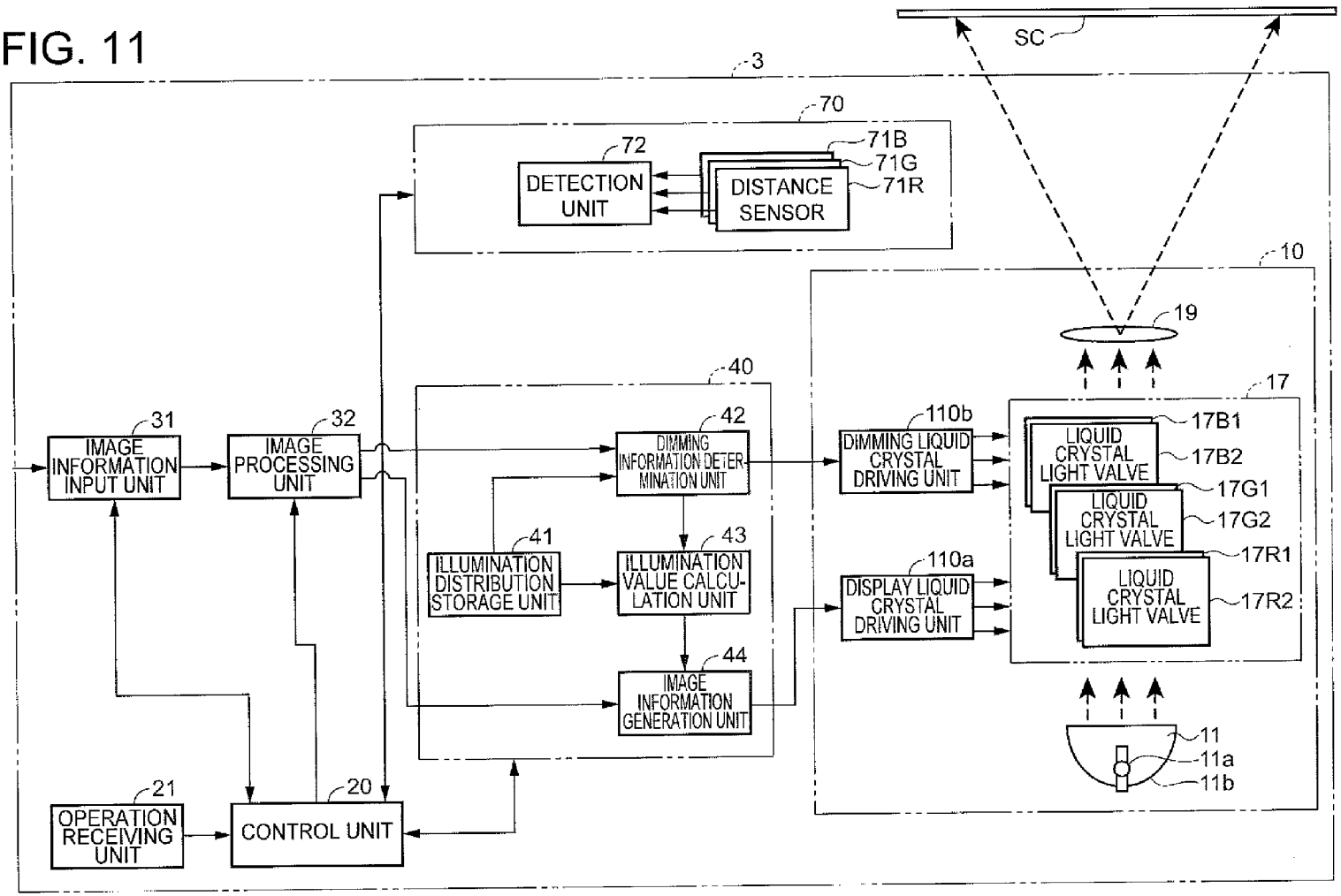
FIG. 11 is a block diagram showing the schematic configuration of a projector according to a third embodiment.

FIG. 11 is a block diagram showing the schematic configuration of a projector 3 according to the third embodiment.

As shown in FIG. 11, the configuration of the projector 3 is the same as that of the projector 1 (refer to FIG. 2) of the first embodiment except for a distance detection unit 70. Therefore, explanation excluding that of the distance detection unit 70 will be omitted. Here, for the same components as in the first embodiment, the same reference numerals are used.

The distance detection unit 70 is configured to include the distance sensors 71R, 71G, and 71B as a second feature quantity detection unit and a detection unit 72 as an information detection unit. The distance detection unit 70 is controlled by the control unit 20. The distance detection unit 70 measures a distance between the liquid crystal light valve for adjusting light and the liquid crystal light valve for display for each color light component and calculates the diffusion of illumination according to the distance, thereby detecting the illumination distribution when the liquid crystal light valve for adjusting light illuminates the liquid crystal light valve for display for each color light component. The distance detection unit 70 corresponds to an illumination distribution detection unit.

When the user operates the operation receiving unit 21, such as an operation panel, provided in the projector 3 to display a menu image or the like and select an illumination distribution detection mode (not shown), the distance detection unit 70 starts an illumination distribution detection mode in which the illumination range SA1 and the intensity distribution are detected.

The distance sensors 71R, 71G, and 71B are configured to include an optical distance meter using a laser or the like or a distance meter using an ultrasonic wave or the like. The distance sensor 71R measures a distance between the liquid crystal light valve for adjusting light 17R2 and the liquid crystal light valve for display 17B1. The distance sensor 71G measures a distance between the liquid crystal light valve for adjusting light 17G2 and the liquid crystal light valve for display 17G1. The distance sensor 71B measures a distance between the liquid crystal light valve for adjusting light 17B2 and the liquid crystal light valve for display 17B1. Then, the distance sensors 71R, 71G, and 71B generate distance information indicating the measured distance, and output the distance information to the detection unit 72.

The detection unit 72 is configured to include a processing unit for analysis and a memory (neither of which is shown). The detection unit 72 stores a plurality of pieces of information (data) of the illumination distribution corresponding to the distance in the form of a table or the like. Then, the detection unit 72 receives the distance information of the light valve for each color light component from the distance sensor 71, and notifies the control unit 20 of the information of the illumination distribution for each color light component according to the distance information. Then, the control unit 20 stores the information of the illumination distribution for each color light component in the illumination distribution storage unit 41. In other words, the information of the illumination distribution of the illumination distribution storage unit 41 is updated.

Here, information of the illumination distribution corresponding to the distance will be described.

FIGS. 12 to 14 are explanatory views showing the information of the illumination distribution.

In the present embodiment, information of illumination distribution T1 that is stored in the illumination distribution storage unit 41 when the distance between the liquid crystal light valve for adjusting light and the liquid crystal light valve for display is small is shown in FIG. 12. Information of illumination distribution T2 that is stored in the illumination distribution storage unit 41 when the distance between the liquid crystal light valve for adjusting light and the liquid crystal light valve for display is moderate is shown in FIG. 13. Information of illumination distribution T3 that is stored in the illumination distribution storage unit 41 when the distance between the liquid crystal light valve for adjusting light and the liquid crystal light valve for display is large is shown in FIG. 14.

As described above, the detection unit 72 stores a plurality of pieces of information of the illumination distribution corresponding to the distance between the liquid crystal light valve for adjusting light and the liquid crystal light valve for display. In addition, although the information of the illumination distribution stored in the detection unit 72 includes the three illumination distributions T1, T2, and T3 in the present embodiment, the number of pieces of information of the illumination distribution is not limited to three. The number of pieces of the information of the illumination distribution may be two or may be four or more.

In addition, since the illumination diffuses according to the distance between the liquid crystal light valve for adjusting light and the liquid crystal light valve for display, it is also possible to measure the diffusion characteristics in advance and to create a mathematical expression therefrom. For example, as shown in the following Expression (6), an expression using a Gaussian distribution is possible.

$$f(\sigma, x) = \frac{1}{\sqrt{2\pi\sigma^2}}\exp\left(-\frac{x^2}{2\sigma^2}\right) \tag{1}$$

σ is a parameter set according to the distance. x is a position (display pixel pitch) in the liquid crystal light valve for display. f(σ, x) is the diffusion characteristics of the illumination in one of the horizontal and vertical directions.

FIGS. 15A to 15D are explanatory views showing the diffusion characteristics based on a Gaussian distribution. FIG. 15A is an explanatory view of the diffusion characteristics in the horizontal direction at a short distance, FIG. 15B is an explanatory view of the diffusion characteristics in the vertical direction at a short distance, FIG. 15C is an explanatory view of the diffusion characteristics in the horizontal direction at a long distance, and FIG. 15D is an explanatory view of the diffusion characteristics in the vertical direction at a long distance.

It is possible to calculate the illumination distribution according to the distance by performing a filtering process for the characteristics of the illumination, which is not diffused, using the diffusion characteristics shown in FIGS. 15A to 15D.

For example, the illumination distribution T2 is generated by performing a filtering process on the diffusion characteristics DC1 in the horizontal direction of the illumination distribution T1 and performing a filtering process on the diffusion characteristics DC2 in the vertical direction of the illumination distribution T1. In addition, the illumination distribution T3 is generated by performing a filtering process on the diffusion characteristics DC3 in the horizontal direction of the illumination distribution T1 and performing a filtering process on the diffusion characteristics DC4 in the vertical direction of the illumination distribution T1.

Figure 16:
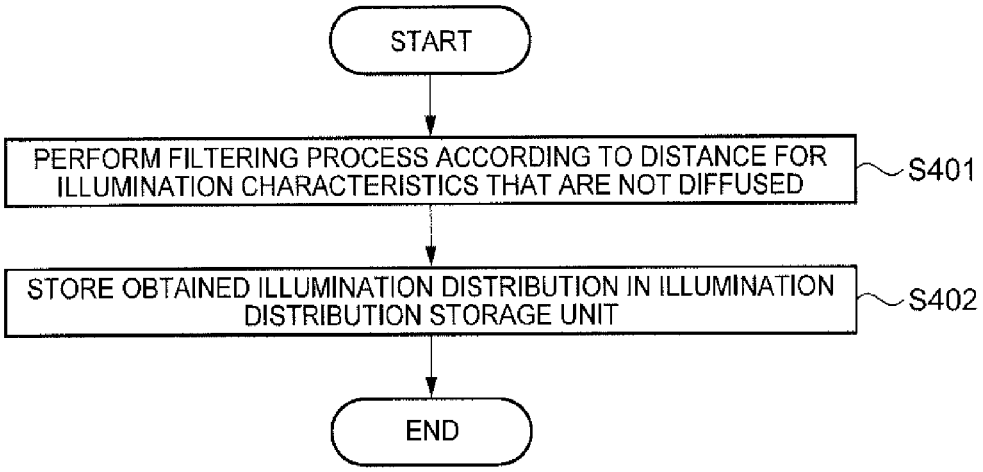
FIG. 16 is a flowchart of the filtering process based on the diffusion characteristics.

FIG. 16 is a flowchart of the filtering process based on the diffusion characteristics.

According to the instruction from the control unit 20, the detection unit 72 performs a filtering process according to the distance between the liquid crystal light valve for adjusting light and the liquid crystal light valve for display for the characteristics of the illumination (illumination distribution T1) that is not diffused (step S401). Then, the detection unit 72 notifies the control unit 20 of the obtained illumination distribution, and the control unit 20 stores the information of the illumination distribution in the illumination distribution storage unit 41 (step S402).

Thus, the detection unit 72 can calculate the information of the illumination distribution, and the control unit 20 can store the information of the illumination distribution in the illumination distribution storage unit 41. Then, based on the information of the illumination distribution that has been calculated, the light valve control unit 40 of the projector 3 performs light valve control corresponding to the illumination distribution. Light valve control processing corresponding to the illumination distribution is the same as that in the first embodiment.

According to the third embodiment described above, the same effects as the effects (2), (3), (4), and (5) of the first embodiment can also be obtained. Other effects are obtained as follows.

(1) In the projector 3, the illumination range SA and the illumination intensity S when the light having passed through the light adjusting pixels of the liquid crystal light valves for adjusting light 17R2, 17G2, and 17B2 illuminates the display pixels of the liquid crystal light valves for display 17R1, 17G1, and 17B1 are stored in the illumination distribution storage unit 41 as information of the illumination distribution. The illumination range SA and the illumination intensity S are determined by the arrangement relationship between each liquid crystal light valve for adjusting light and the corresponding liquid crystal light valve for display. The illumination range SA and the illumination intensity S are measured in advance during development of the products and are stored in the illumination distribution storage unit 41. However, the illumination range SA and the illumination intensity S change due to an assembling error, a temporal change, or the like of the product. In the projector 3, it is possible to rewrite the information stored in the illumination distribution storage unit 41 using the distance sensors 71R, 71G, and 71B and the detection unit 72 of the distance detection unit 70 and the control unit 20. Therefore, it is advantageous because, even when the illumination distribution changes from the initial state, the projector 3 can realize accurate gradation reproduction by rewriting the illumination range SA and the illumination intensity S stored in the illumination distribution storage unit 41, that is, the illumination distribution.

Fourth Embodiment

Hereinafter, as a fourth embodiment, a projector capable of detecting the illumination distribution by measuring the ambient temperature of the liquid crystal light valve for adjusting light and the liquid crystal light valve for display will be described with reference to the accompanying diagrams.

When a projector 4 projects an image, the liquid crystal light valve for adjusting light, the liquid crystal light valve for display, and components therearound produce heat. The distance between the liquid crystal light valve for adjusting light and the liquid crystal light valve for display changes due to thermal expansion caused by heat. There is a one-to-one correspondence between a temperature change and a distance change. Therefore, in the present embodiment, distance information is calculated from temperature information, and the illumination distribution is detected as shown in the third embodiment.

FIG. 1 of the first embodiment from which the image sensors 51R, 51G, and 51B are excluded corresponds to the schematic diagram showing an optical unit of the projector of the fourth embodiment. In addition, a temperature sensor 81 is placed near the liquid crystal light valve for adjusting light and the liquid crystal light valve for display, but illustration thereof is omitted herein. The other configuration is the same as that shown in FIG. 1. Therefore, explanation thereof will be omitted.

Figure 17:
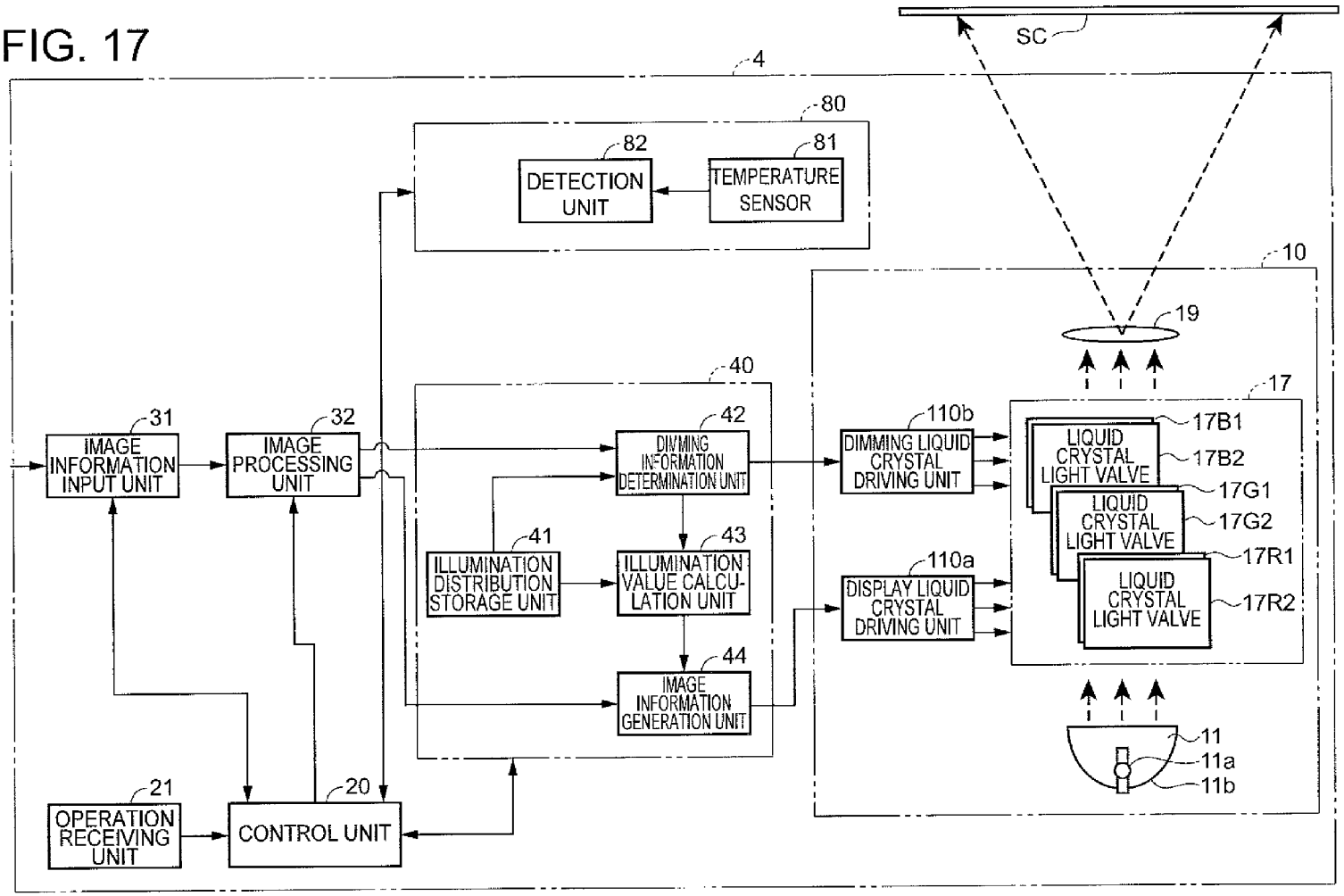
FIG. 17 is a block diagram showing the schematic configuration of a projector according to a fourth embodiment.

FIG. 17 is a block diagram showing the schematic configuration of the projector 4 according to the fourth embodiment.

As shown in FIG. 17, the configuration of the projector 4 is the same as that of the projector 1 (refer to FIG. 2) of the first embodiment except for a temperature detection unit 80. Therefore, explanation excluding that of the temperature detection unit 80 will be omitted. Here, for the same components as in the first embodiment, the same reference numerals are used.

The temperature detection unit 80 is configured to include the temperature sensor 81 as a second feature quantity detection unit and a detection unit 82 as an information detection unit. The temperature detection unit 80 is controlled by the control unit 20. The temperature detection unit 80 measures the temperature near the liquid crystal light valve for adjusting light and the liquid crystal light valve for display and calculates the diffusion characteristics of the illumination corresponding to the distance according to the temperature, thereby detecting the illumination distribution when the liquid crystal light valve for adjusting light illuminates the liquid crystal light valve for display. The temperature detection unit 80 corresponds to an illumination distribution detection unit.

When the user operates the operation receiving unit 21, such as an operation panel, provided in the projector 4 to display a menu image or the like and select an illumination distribution detection mode (not shown), the temperature detection unit 80 starts an illumination distribution detection mode in which the illumination range SA1 and the intensity distribution are detected.

The temperature sensor 81 is configured to include a thermistor and the like. The temperature sensor 81 is placed near the liquid crystal light valve for adjusting light and the liquid crystal light valve for display, and detects temperature. The information of the detected temperature is output to the detection unit 82.

The detection unit 82 is configured to include a processing unit for analysis and a memory (neither of which is shown). The detection unit 82 calculates a distance according to the temperature. Here, the relationship between the temperature and the distance is measured in advance for the light valve of each color light component, and is stored in the detection unit 82. The detection unit 82 calculates the information of the illumination distribution according to the distance. As a calculation method in this case, the same calculation method as used for the detection unit 72 of the distance detection unit 70 described in the third embodiment is used. The detection unit 82 notifies the control unit 20 of the information of the illumination distribution that has been calculated for each color light component, and the control unit 20 stores the information of the illumination distribution in the illumination distribution storage unit 41. In other words, the information of the illumination distribution of the illumination distribution storage unit 41 is updated.

In addition, since there is a one-to-one correspondence between the temperature and the distance as described above, the detection unit 82 may store a plurality of pieces of information (data) of the illumination distribution corresponding to the temperature in the form of a table or the like without calculating the distance according to the temperature. In addition, even when expressing the diffusion characteristics as a mathematical expression (refer to Expression (6)), a parameter set according to the distance can be replaced with a parameter set according to the temperature to calculate the diffusion characteristics. In addition, it is possible to calculate the illumination distribution according to the temperature by performing a filtering process for the characteristics of the illumination, which is not diffused, using the diffusion characteristics.

Based on the information of the illumination distribution calculated as described above, the light valve control unit 40 of the projector 4 performs light valve control corresponding to the illumination distribution. Light valve control processing corresponding to the illumination distribution is the same as that in the first embodiment.

According to the fourth embodiment described above, the same effects as the effects (2), (3), (4), and (5) of the first embodiment can also be obtained. Other effects are obtained as follows.

(1) In the projector 4, the illumination range SA and the illumination intensity S when the light having passed through the light adjusting pixels of the liquid crystal light valves for adjusting light 17R2, 17G2, and 17B2 illuminates the display pixels of the liquid crystal light valves for display 17R1, 17G1, and 17B1 are stored in the illumination distribution storage unit 41 as information of the illumination distribution. The illumination range SA and the illumination intensity S are determined by the arrangement relationship between each liquid crystal light valve for adjusting light and the corresponding liquid crystal light valve for display. The illumination range SA and the illumination intensity S are measured in advance during development of the products and are stored in the illumination distribution storage unit 41. However, the illumination range SA and the illumination intensity S change due to an assembling error, a temporal change, a temperature change, or the like of the product. In the projector 4, it is possible to rewrite the information stored in the illumination distribution storage unit 41 using the temperature sensor 81 and the detection unit 82 of the temperature detection unit 80 and the control unit 20. Therefore, it is advantageous because, even when the illumination distribution changes from the initial state, the projector 4 can realize accurate gradation reproduction by rewriting the illumination range SA and the illumination intensity S stored in the illumination distribution storage unit 41, that is, the illumination distribution.

In addition, the invention is not limited to the embodiments described above, and various changes, improvements, and the like can be additionally made thereto.

Modification examples will be described below.

Modification Example 1

Although the feature quantity used in the light adjusting information determination unit 42 is set to the maximum value of the first image information in the embodiments described above, the feature quantity used in the light adjusting information determination unit 42 does not necessarily need to be the maximum value. For example, a bright pixel may be included in a dark screen region as noise. In such a case, if the feature quantity is set to the maximum value, black may stand out. For this reason, the feature quantity does not necessarily need to be the maximum value. For example, the feature quantity may be set to 90% of the pixel value of the maximum value, or may be set to an average value. In addition, the feature quantity may be set to a certain pixel value subsequent to the maximum value. For example, the feature quantity may be set to the third pixel value from the maximum value. In addition, it is also possible to include a histogram detection unit (not shown) that extracts a histogram (frequency-of-occurrence distribution) of each color of the red light LR, the green light LG, and the blue light LB from the first image information (video signal), so that the feature quantity is determined based on the frequency distribution.

Modification Example 2

Each of the projectors 1, 2, 3, and 4 may include a noise reduction circuit (not shown). By removing the noise by performing a noise reduction process on the first image information input to the light valve control unit 40, the feature quantity used in the light adjusting information determination unit 42 may be set to the maximum value of the first image information.

Modification Example 3

Figure 18:
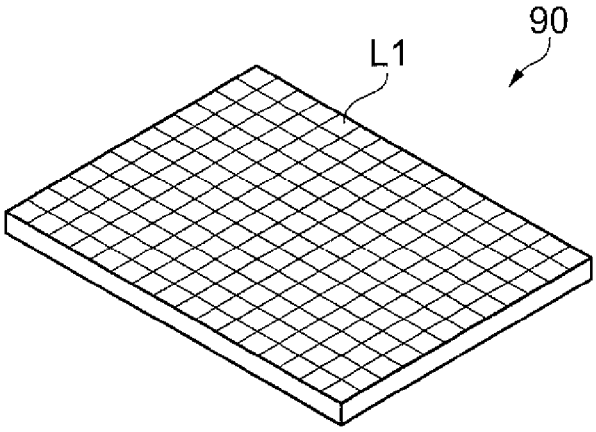
FIG. 18 is a perspective view of an LED array.

In the embodiments described above, the lighting unit has a configuration including the light source device 11 and the liquid crystal light valve for adjusting light. However, the lighting unit may be integrally configured as a light emitting diode (LED) array, for example. That is, the lighting unit may be an LED array. FIG. 18 is a perspective view of an LED array. As shown in FIG. 18, an LED array 90 is formed by arraying a plurality of light emitting portions (LEDs) L1 in a matrix. The LED array 90 may be provided instead of the liquid crystal light valves for adjusting light 17R2, 17G2, and 17B2 of the projectors 1, 2, 3, and 4. In addition, when the image display device is a flat panel display (FPD) or the like, the LED array 90 may be provided as a lighting unit on the back side of the liquid crystal panel or the like of the FPD. In this case, each of the plurality of light emitting portions L1 included in the LED array 90 corresponds to a light adjusting element.

Modification Example 4

In the configuration diagram of the optical unit of the projector of each of the embodiments described above, a configuration is shown in which an optical element (relay lens) or the like is not provided between the liquid crystal light valve for adjusting light and the liquid crystal light valve for display. However, in the first to third embodiments, an optical element or the like may be provided between the liquid crystal light valve for adjusting light and the liquid crystal light valve for display. That is, even if an optical element or the like is provided in the projectors 1, 2, and 4, it is possible to detect a change in the illumination distribution and to update the information of the illumination distribution of the illumination distribution storage unit 41. In addition, distances between the liquid crystal light valve for adjusting light and the liquid crystal light valve for display for red light, green light, and blue light may not be the same.

Modification Example 5

In the embodiments described above, the information of the illumination range SA and the illumination intensity S (intensity distribution), that is, the information of the illumination distribution is stored in the illumination distribution storage unit 41 in advance. However, the information of the illumination distribution may not be stored in advance. In this case, before starting the normal use (projection) of the projector, it is possible to set the mode of the projectors 1, 2, 3, and 4 to the illumination distribution detection mode, detect the information of the illumination distribution with the illumination distribution detection unit (the imaging detection unit 50, the imaging detection unit 60, the distance detection unit 70, and the temperature detection unit 80), and store the information of the illumination distribution in the illumination distribution storage unit 41 with the control unit 20.

Modification Example 6

In the embodiments described above, the illumination range SA and the illumination intensity S (intensity distribution) are stored in the illumination distribution storage unit 41 in advance, and the control unit 20 updates the illumination range SA and the illumination intensity S (intensity distribution) based on the information of the illumination distribution detected by the illumination distribution detection unit. However, the illumination range SA and the illumination intensity S may be configured to be writable or rewritable by other means. For example, each of the projectors 1, 2, 3, and 4 may include a communication unit (not shown) that receives the information of the illumination range SA and the illumination intensity S from a device outside the projectors 1, 2, 3, and 4, and the information stored in the illumination distribution storage unit 41 may be rewritten by the control unit 20.

Modification Example 7

In the embodiments described above, in the illumination distribution detection process, only one light adjusting pixel of the liquid crystal light valve for adjusting light is turned on to detect the illumination distribution. However, it is also possible to detect the illumination distribution for each of a plurality of light adjusting pixels by performing the illumination distribution detection process multiple times. In addition, a plurality of illumination distributions may be stored in the illumination distribution storage unit 41 so that the illumination distribution is switched according to the position of the light adjusting pixel of the liquid crystal light valve for adjusting light.

Modification Example 8

In the first embodiment described above, each of the image sensors 51R, 51G, and 51B is movable by the sensor driving unit. However, when using a transmissive image sensor, the image sensor may be fixed to the incidence surface of the liquid crystal light valve for display.

Modification Example 9

In the embodiments described above, the illumination distribution detection process performed in the illumination distribution detection mode shown in the first and second embodiments or the illumination distribution detection process performed in the other embodiments are assumed to be performed according to the instruction from the control unit 20 based on the user operation. However, the illumination distribution detection process performed in the illumination distribution detection mode shown in the first and second embodiments or the illumination distribution detection process performed in the other embodiments may be performed at a predetermined timing. For example, the illumination distribution detection process performed in the illumination distribution detection mode shown in the first and second embodiments or the illumination distribution detection process performed in the other embodiments may be performed at the start of the projector.

Modification Example 10

Although the projectors 1, 2, 3, and 4 have been mentioned as examples in the embodiments described above, the image display device is not limited to the projector. For example, the invention can also be applied to a rear projector, a liquid crystal display, a plasma display, an organic electroluminescence (EL) display, and the like that integrally include a transmissive screen.

Modification Example 11

In the embodiments described above, the light source device 11 is configured to include a discharge type light source lamp 11*a*. However, it is also possible to use a solid-state light source, such as an LED light source or a laser, or other light sources.

Modification Example 12

In the embodiments described above, each of the projectors 1, 2, 3, and 4 uses the transmissive liquid crystal light valves 17R1, 17G1, and 17B1 as a first light modulation device. However, it is also possible to use a reflective light modulation device, such as a reflective liquid crystal light valve. For example, a micromirror array device that modulates light emitted from the light source by controlling the emission direction of incident light for each micromirror as a pixel can also be used as a light modulation device. Similarly, although the transmissive liquid crystal light valves 17R2, 17G2, and 17B2 are used as a light modulation device included in the lighting unit, it is also possible to use a reflective light modulation device, such as a reflective liquid crystal light valve. For example, a micromirror array device that modulates light emitted from the light source by controlling the emission direction of incident light for each micromirror as a pixel can also be used as a light modulation device.

What is claimed is:

1. An image display device, comprising:

a first light modulation device that includes a plurality of light valves, each of the light valves including a plurality of display pixels, the first light modulation device being configured to modulate light based on first image information;

a lighting unit that includes a plurality of light adjusting elements, each of the light adjusting elements emitting adjusted light to a respective light valve of the plurality of light valves;

an illumination distribution storage unit that stores an illumination range information, the illumination range information represents an illumination range when light emitted from the light adjusting elements illuminates the display pixels of the light valves;

a light adjusting information determination unit that determines light adjusting information for controlling the light adjusting elements of the lighting unit based on a feature quantity of the first image information corresponding to the display pixels in the illumination range;

an illumination distribution detection unit that detects an illumination distribution information, the illumination distribution information represents an illumination distribution when light emitted from the light adjusting pixels of the lighting unit illuminates the display pixels of the light valves, wherein the illumination distribution detection unit is configured to include a plurality of image sensor units, which captures a light image, and an information detection unit, which detects the information of the illumination distribution based on captured image data obtained by imaging performed by each of the plurality of image sensor units; and an illumination distribution updating unit that updates the illumination range information based on the illumination distribution information, the light adjusting elements comprising a plurality of light adjusting pixels, and the illumination distribution detection unit determining the illumination distribution information by sequentially turning on each of the light adjusting pixels one at a time while capturing information of the illumination distribution corresponding to the respective one of the light adjusting pixels that is turned on, wherein, before the illumination distribution detection unit detects the illumination distribution information, the plurality of image sensor units do not cover an incidence surface of each of the plurality of light valves, and when the illumination distribution detection unit detects the illumination distribution information, the plurality of image sensors cover the incidence surface of each of the plurality of light valves.

2. The image display device according to claim 1, wherein the illumination distribution storage unit further stores distribution information of an illumination intensity when light emitted from the light adjusting elements illuminates the display pixels of the first light modulation device, the illumination distribution updating unit updates the distribution information of the illumination intensity stored in the illumination distribution storage unit based on the information of the illumination distribution detected by the illumination distribution detection unit, and the image display device further includes an illumination value calculation unit, which calculates an illumination value of light reaching each of the display pixels of the first light modulation device based on the light adjusting information of the lighting unit and the distribution information of the illumination intensity, and an image information generation unit, which generates second image information to be set in the first light modulation device based on the first image information and the illumination value calculated by the illumination value calculation unit.

3. The image display device according to claim 2, wherein, in the image information generation unit, a value obtained by dividing a pixel value of the first image information by the illumination value is set as a pixel value of the second image information.

4. The image display device according to claim 1, wherein, in the light adjusting information determination unit, the feature quantity of the first image information is set to a maximum value of a pixel value of the first image information in the illumination range.

5. The image display device according to claim 1, wherein the plurality of image sensor units generate the captured image data by capturing a light image when light emitted from the light adjusting pixels of the lighting unit reaches the first light modulation device.

6. The image display device according to claim 1, wherein the plurality of image sensor units generate the captured image data by imaging a range including an image displayed by the image display device.

7. The image display device according to claim 1, wherein the illumination distribution detection unit is configured to include a second feature quantity detection unit, which detects a second feature quantity that affects an illumination distribution, and an information detection unit, which detects the information of the illumination distribution based on the second feature quantity detected by the second feature quantity detection unit.

8. The image display device according to claim 7, wherein the second feature quantity detection unit detects a distance between the lighting unit and the first light modulation device as the second feature quantity.

9. The image display device according to claim 7, wherein the second feature quantity detection unit detects an ambient temperature of the lighting unit and the first light modulation device as the second feature quantity.

10. A control method of an image display device including a first light modulation device that includes a plurality of light valves, each of the light valves including a plurality of display pixels the first light modulation device being configured to modulate light based on first image information, a lighting unit that includes a plurality of light adjusting elements, each of the light adjusting elements emitting adjusted light to a respective light valve of the plurality of light valves, and an illumination distribution storage unit that stores an illumination range information, the illumination range information represents an illumination range when light emitted from the light adjusting elements illuminates the display pixels of the light valves, the control method comprising:

determining light adjusting information for controlling the light adjusting elements of the lighting unit based on a feature quantity of the first image information corresponding to the display pixels in the illumination range;

detecting an illumination distribution information using an illumination distribution detection unit, the illumination distribution information represents an illumination distribution when light emitted from the light adjusting pixels of the lighting unit illuminates the display pixels of the light valve, wherein the detecting is performed with a plurality of image sensor units, which captures a light image, and wherein the detecting includes detecting the illumination distribution based on captured image data obtained by imaging performed by the plurality of image sensor units; and updating the illumination range information based on the illumination distribution information, the light adjusting elements comprising a plurality of light adjusting pixels, and the illumination distribution detection unit determines the illumination distribution information by sequentially turning on each of the light adjusting pixels one at a time while capturing information of the illumination distribution corresponding to the respective one of the light adjusting pixels that is turned on, wherein, before the illumination distribution detection unit detects the illumination distribution information, the plurality of image sensor units do not cover an incidence surface of each of the plurality of light valves, and when the illumination distribution detection unit detects the illumination distribution information, the plurality of image sensors cover the incidence surface of each of the plurality of light valves.

11. The control method of an image display device according to claim 10, wherein the illumination distribution storage unit further stores distribution information of an illumination intensity when light emitted from the light adjusting elements illuminates the display pixels of the first light modulation device, in the updating of the illumination distribution, the distribution information of the illumination intensity stored in the illumination distribution storage unit is updated based on the information of the illumination distribution detected in the detection of the illumination distribution, and the method further includes calculating an illumination value of light reaching each of the display pixels of the first light modulation device based on the light adjusting information of the lighting unit and the distribution information of the illumination intensity and generating second image information to be set in the first light modulation device based on the first image information and the illumination value calculated in the calculation of the illumination value.

* * * * *